US007347134B2

(12) United States Patent
Lewis et al.

(10) Patent No.: US 7,347,134 B2
(45) Date of Patent: Mar. 25, 2008

(54) NO TOUCH DISPENSER FOR SHEET MATERIAL WITH AUTOMATIC ADVANCE

(75) Inventors: Richard Paul Lewis, Marietta, GA (US); Paul Francis Tramontina, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 401 days.

(21) Appl. No.: 10/953,506

(22) Filed: Sep. 29, 2004

(65) Prior Publication Data

US 2006/0065094 A1 Mar. 30, 2006

(51) Int. Cl.
*B65H 20/26* (2006.01)
*B65H 35/04* (2006.01)

(52) U.S. Cl. ..... 83/649; 83/629; 83/949; 225/10; 424/564; 424/564.4; 226/127

(58) Field of Classification Search ..... 83/335, 83/649, 650, 629, 949; 225/10, 47; 242/564, 242/565, 564.1, 564.3, 564.4; 226/121, 127, 226/128, 129

See application file for complete search history.

(56) References Cited

U.S. PATENT DOCUMENTS

| | | | |
|---|---|---|---|
| 2,278,029 | A | 3/1942 | Walsh et al. |
| 2,560,061 | A | 7/1951 | Agamaite Jr. |
| 3,606,125 | A | 9/1971 | Tucker et al. |
| 3,672,552 | A | 6/1972 | Krueger |
| 3,697,146 | A | 10/1972 | Boisen |
| 3,713,569 | A | 1/1973 | Dashnier et al. |
| 3,739,965 | A | 6/1973 | Jespersen et al. |
| 3,896,691 | A | 7/1975 | Granger et al. |
| 3,924,476 | A | 12/1975 | Wolcott |
| RE28,911 | E | 7/1976 | Jespersen et al. |

(Continued)

FOREIGN PATENT DOCUMENTS

| | | |
|---|---|---|
| EP | 0930039 A1 | 7/1999 |

(Continued)

OTHER PUBLICATIONS

US 4,176,569, DeLuca (withdrawn).

(Continued)

*Primary Examiner*—Boyer D. Ashley
*Assistant Examiner*—Edward Landrum
(74) *Attorney, Agent, or Firm*—Dority & Manning

(57) ABSTRACT

A dispenser for dispensing and advancing sheet material is provided. The dispenser includes a frame and a drive roller rotationally mounted to the frame. The drive roller is configured for engagement with sheet material so that rotation of the drive roller causes movement of the sheet material. A segmented gear with first and second drive segments is mounted to the frame and is in communication with the drive roller. A spring is included and is in communication with the segmented gear. The spring is configured so that rotation of the segmented gear causes the spring to store potential energy. Release of potential energy in the spring causes the segmented gear to rotate. A cutting blade is provided and is configured for cutting the sheet material in order to release potential energy. The dispenser allows for a piece of sheet material to be dispensed therefrom and subsequently presents the user with a new piece of sheet material for future removal.

21 Claims, 19 Drawing Sheets

U.S. PATENT DOCUMENTS 3,998,120 A 12/1976 Granger et al.
4,106,684 A 8/1978 Hartbauer et al.
4,122,738 A 10/1978 Granger
4,142,431 A 3/1979 Jespersen
4,188,844 A 2/1980 DeLuca
4,192,442 A * 3/1980 Bastian et al. ..... 226/127
4,203,562 A 5/1980 DeLuca et al.
4,206,858 A 6/1980 DeLuca et al.
4,213,363 A 7/1980 Granger
4,276,797 A 7/1981 Baumann et al.
4,286,489 A 9/1981 DeLuca
4,307,638 A 12/1981 DeLuca et al.
4,307,639 A 12/1981 DeLuca
4,340,195 A 7/1982 DeLuca
4,358,169 A 11/1982 Filipowitcz et al.
4,362,278 A 12/1982 Hopkinson
4,404,880 A 9/1983 DeLuca
4,432,261 A 2/1984 DeLuca
4,441,392 A 4/1984 DeLuca
4,488,466 A 12/1984 Jones
4,552,315 A 11/1985 Granger
4,579,268 A 4/1986 Cornell
4,610,407 A 9/1986 Stubbmann
4,611,768 A 9/1986 Voss et al.
4,621,755 A 11/1986 Granger
4,634,033 A 1/1987 Lloyd
4,635,837 A 1/1987 Granger
4,648,530 A 3/1987 Granger
4,660,781 A 4/1987 Hazard
4,664,304 A 5/1987 Wendt et al.
4,699,034 A 10/1987 Sue
4,699,304 A 10/1987 Voss et al.
4,712,461 A 12/1987 Rasmussen
D293,750 S 1/1988 Leotta
4,723,306 A 2/1988 Fuenfgelder et al.
4,738,384 A 4/1988 Tigner
4,786,005 A * 11/1988 Hoffman et al. ..... 242/564.1
4,790,490 A 12/1988 Chakravorty
4,807,824 A 2/1989 Gains et al.
4,844,361 A 7/1989 Granger
4,846,035 A 7/1989 Granger
4,943,341 A 7/1990 Mattei
4,960,248 A 10/1990 Bauer et al.
D312,179 S 11/1990 DeLuca et al.
5,000,069 A 3/1991 Knobel
5,013,291 A 5/1991 Granger
5,048,386 A 9/1991 DeLuca et al.
5,054,706 A 10/1991 Maurice
5,065,924 A 11/1991 Granger
5,078,033 A 1/1992 Formon
5,107,734 A 4/1992 Armbruster
5,108,357 A 4/1992 Granger
5,135,147 A 8/1992 Granger
5,146,830 A 9/1992 Granger
5,147,279 A 9/1992 Granger
5,161,723 A 11/1992 Wirtz-Odenthal
D332,023 S 12/1992 Campbell
5,203,036 A 4/1993 Juushi
5,205,454 A 4/1993 Schutz et al.
5,207,633 A 5/1993 Granger
D337,679 S 7/1993 Guigiaro
5,244,161 A 9/1993 Wirtz-Odenthal
5,249,755 A 10/1993 Jespersen
5,257,711 A 11/1993 Wirtz-Odenthal
5,294,192 A 3/1994 Omdall et al.
D346,519 S 5/1994 Krueger et al.
D347,135 S 5/1994 Morand
D347,535 S 6/1994 Krueger et al.
5,318,210 A 6/1994 Morand
5,335,811 A 8/1994 Morand
5,359,915 A 11/1994 Hitz
5,375,785 A 12/1994 Boone et al.
5,410,930 A 5/1995 DeLuca et al.
5,441,189 A 8/1995 Formon et al.
5,452,832 A 9/1995 Niada
D363,628 S 10/1995 McCanless
D365,713 S 1/1996 Chen
5,526,973 A 6/1996 Boone et al.
5,558,302 A 9/1996 Jesperson
5,630,526 A 5/1997 Moody
5,647,261 A 7/1997 Wierenga
D385,445 S 10/1997 Arbak et al.
5,692,440 A 12/1997 Hillebrand
5,772,291 A 6/1998 Byrd et al.
5,788,136 A 8/1998 Othman
5,826,479 A 10/1998 Suzuki et al.
5,833,169 A 11/1998 Morand
5,836,862 A 11/1998 Granger
5,860,578 A 1/1999 Laguna
5,865,395 A 2/1999 Wei
5,868,343 A 2/1999 Granger
5,908,137 A 6/1999 Pattarozzi
5,915,645 A 6/1999 Granger
5,924,617 A 7/1999 LaCount et al.
5,937,718 A 8/1999 Granger
5,954,256 A 9/1999 Niada
5,967,011 A 10/1999 Feldkamper et al.
5,975,456 A 11/1999 Bodkin et al.
5,979,062 A 11/1999 Prosan
5,979,284 A 11/1999 Granger
5,979,821 A 11/1999 LaCount et al.
5,979,822 A 11/1999 Morand et al.
6,006,642 A 12/1999 Granger
6,012,674 A 1/2000 Leeuwenburgh
6,027,002 A 2/2000 Granger
6,032,898 A 3/2000 LaCount et al.
D426,412 S 6/2000 Cameron
6,079,305 A 6/2000 Bloch et al.
6,089,401 A 7/2000 Sal.ang.ker
6,092,451 A 7/2000 Granger
D429,931 S 8/2000 Conran et al.
D429,932 S 8/2000 Conran et al.
6,098,917 A 8/2000 Cruz
6,102,269 A 8/2000 Elliott et al.
6,105,898 A 8/2000 Byrd et al.
D430,764 S 9/2000 Conran et al.
6,112,631 A 9/2000 VanAlstine
6,179,243 B1 1/2001 Granger
D437,154 S 2/2001 Conran et al.
6,182,550 B1 * 2/2001 Brewington et al. ..... 83/603
D439,456 S 3/2001 Ehrensperger
6,196,102 B1 3/2001 Granger
6,206,322 B1 * 3/2001 Elliott et al. ..... 242/564.2
6,224,010 B1 5/2001 Morand
6,237,871 B1 5/2001 Morand et al.
6,250,530 B1 6/2001 LaCount et al.
6,293,486 B1 9/2001 Byrd et al.
6,363,824 B1 4/2002 Granger
6,363,825 B1 4/2002 Hagleitner
6,378,725 B1 4/2002 Granger
6,415,948 B1 7/2002 Granger
6,416,011 B2 7/2002 Granger
6,684,751 B2 * 2/2004 Kapiloff et al. ..... 83/649
2003/0019971 A1 1/2003 Lewis et al.

FOREIGN PATENT DOCUMENTS

WO WO 9214590 3/1992

OTHER PUBLICATIONS

International Search Report and Written Opinion, Jun. 29, 2005.

* cited by examiner

NO TOUCH DISPENSER FOR SHEET MATERIAL WITH AUTOMATIC ADVANCE

BACKGROUND

Dispensers exist for use in storing and dispensing sheet material such as paper towels, napkins, toilet paper, paper products and the like. The dispensers are normally located in restaurants, kitchens, restrooms or other places in which a need for such sheet material exists. The dispensers are usually configured to function in the most sanitary manner possible as they are used in areas where cleanliness is desirable.

Certain types of dispensers are configured to house a roll of sheet material such that a free end of sheet material is presented for a user. The sheet material is sometimes engaged with a drive roller inside of the housing so that pulling of the free end by the user will cause the drive roller to rotate due to frictional engagement with the sheet material. The drive roller may include a drive mechanism that allows the drive roller to rotate a predetermined number of degrees so that a predetermined length of sheet material is dispensed for the user. A cutting mechanism may be configured into or with the drive mechanism in order to cut the sheet material.

A feeding mechanism, such as an eccentric spring mechanism, may be included that causes the drive roller to rotate once the sheet material has been cut. This action causes a predetermined length of sheet material to be subsequently dispensed so that once again a free end of the sheet material is presented to a future user for dispensing. In some instances, the drive roller may be equipped with a cutting tool such as a bar, blade or the like that extends from a retracted position to an extended position once the drive roller reaches a predetermined rotational position that causes cutting of the sheet material.

Dispensers of the described type are typically known by various names such as "sanitary" dispensers, "no touch" dispensers, or "hands-free" dispensers because the user does not have to manually operate any portion of the dispenser. The present application refers to these types of dispensers as "no touch" dispensers. The user of this type of dispenser only needs to touch the free end of the particular piece of sheet material that he or she is dispensing for his or her use. The spread of germs to or from the dispenser and sheet material in the dispenser is eliminated because the user is only touching his or her own piece of sheet material.

Although prior "no touch" dispensers work well for their intended purpose, they are sometimes difficult or expensive to manufacture or use due to their complex construction. Additionally, reliability is sometimes a problem in that sheet material can get jammed inside of the dispenser or a user may inadvertently tear off a portion of the sheet material instead of fully pulling the sheet material to cause a full dispense. The present invention improves upon "no touch" sheet dispensers in providing a mechanism for automatic dispensing that is reliable and is less expensive and complex than prior mechanisms used in "no touch" dispensers.

SUMMARY

Various features and advantages of the invention will be set forth in part in the following description, or may be obvious from the description, or may be learned from practice of the invention.

The present invention provides for a "no touch" dispenser that allows a user to remove a piece of sheet material without having to contact either the dispenser or another piece of sheet material in the dispenser. The dispenser includes a mechanism that allows for another piece of sheet material to be automatically advanced and presented to the user once the first piece of sheet material is removed.

The dispenser in accordance with the present invention includes a frame and drive roller that is rotationally mounted to the frame. The drive roller is configured for engagement with sheet material so that rotation of the drive roller causes movement of the sheet material.

A segmented gear is included and is mounted to the frame. The segmented gear is in communication with the drive roller, and the segmented gear includes a first and second drive segment. A spring is provided and is placed in communication with the segmented gear and is configured so that movement of the segmented gear causes the spring to store potential energy. Likewise, the release of potential energy in the spring causes the segmented gear to move. A cutting blade is provided and is configured for cutting the sheet material in order to release potential energy in the spring. As such, the dispenser is configured so that cutting of the sheet material will cause a release in potential energy in the spring that in turn causes the segmented gear to move which causes the drive roller to rotate and induces movement of the sheet material.

In a particular embodiment of the invention, the segmented gear is a segment gear that is rotationally mounted to the frame.

In one embodiment, a dispenser is set forth as above where the cutting blade is stationary with respect to the frame. Alternatively, the dispenser may be configured so that the cutting blade is moveable relative to the frame in order to engage and cut the sheet material.

When configured with a moveable cutting blade, the dispenser may be configured with a cutting blade idler gear that is rotationally mounted to the frame. Further, a cutting blade drive gear may also be included and may be rotationally mounted to the frame and in communication with the cutting blade idler gear. Further, a gear rack may be rigidly attached to the cutting blade and in communication with the cutting blade drive gear. In such a configuration, the cutting blade idler gear may rotate in order to cause rotation of the cutting blade drive gear which in turn cooperates with the gear rack to act as a rack and pinion arrangement in order to move the cutting blade so as to engage and cut the sheet material.

The cutting blade may be configured to be moveable by way of an alternative arrangement. Here, the dispenser is provided with both a cutting blade idler gear and a cutting blade drive gear that are each rotationally mounted to the frame and in communication with one another. The cutting blade is rigidly attached to the cutting blade drive gear. In this manner, rotation of the cutting blade idler gear will cause a corresponding rotation of the cutting blade drive gear that in turn causes the cutting blade to rotationally move in order to engage and cut the sheet material.

In a particular embodiment in accordance with the present invention, a dispenser as set forth above is provided in which the spring is a torsion spring. Additionally or alternatively, a float gear may be provided that is both rotationally and slideably mounted to the frame. The float gear may be incorporated in order to place the segment gear into communication with the drive roller.

With still an alternate embodiment in accordance with the present invention, the drive roller may be slideably mounted to the frame. Additionally, the dispenser as previously discussed may be arranged so that the segment gear defines a cam surface that is configured for engaging the cutting blade so as to cause the cutting blade to be moved in order to cut the sheet material.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Figure 1:
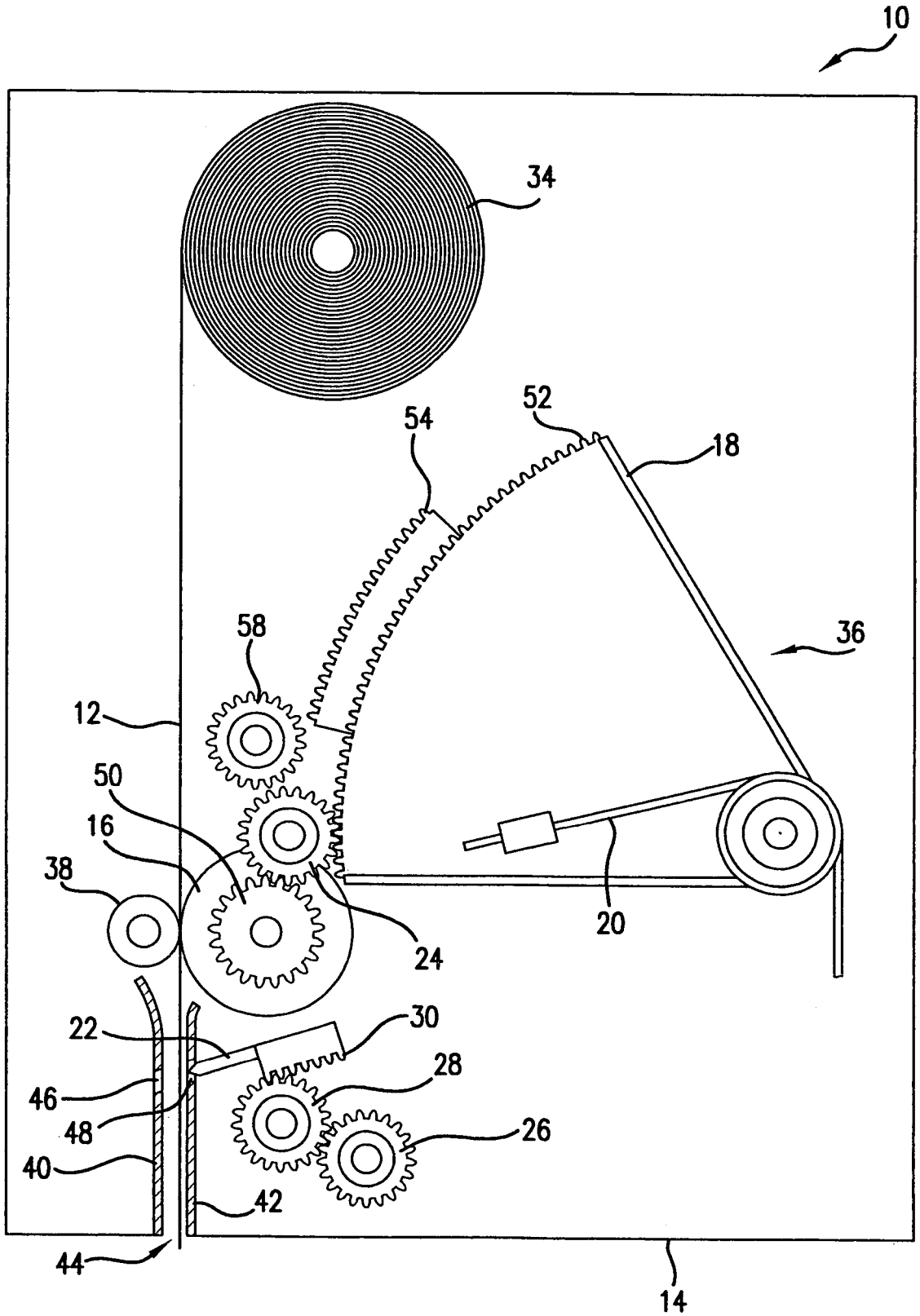
FIG. 1 is a side elevation view of a dispenser in accordance with the present invention that shows the dispensing mechanism in a ready to dispense position.

Repeat use of reference characters in the present specification and drawings is intended to present same or analogous features or elements of the invention.

DETAILED DESCRIPTION

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges and limits mentioned herein include all ranges located within, and also all values located under or above the prescribed limits. For instance, a range from 100-200 also includes ranges from 110-150, 170-190, and 153-162. Further, a limit of up to about 7 also includes a limit of up to about 5, up to about 3, and up to about 4.5.

Referring to FIG. 1, the present invention provides for a dispenser 10 that is configured as a "no touch" dispenser that allows for sheet material 12 to be dispensed therefrom without having the user contact either the dispenser 10 or another piece of sheet material 12 contained therein. The dispenser 10 is provided with a dispensing mechanism 36 that allows for a piece of sheet material 12 to be dispensed from the dispenser 10 by a user and subsequently automatically advances a second piece of sheet material 12 for future removal so that a user does not have to touch the dispenser 10. The dispensing mechanism 36 may be configured in a number of ways in accordance with various exemplary embodiments of the present invention. For instance, the dispensing mechanism 36 may be configured so that the user will draw the sheet material 12 against a stationary cutting blade 22 in order to sever the piece of sheet material 12 and cause removal. Alternatively, the dispensing mechanism 36 may be configured so that the cutting blade 22 is moveable so as to automatically sever the sheet material 12 when pulled by a user.

Figure 2:
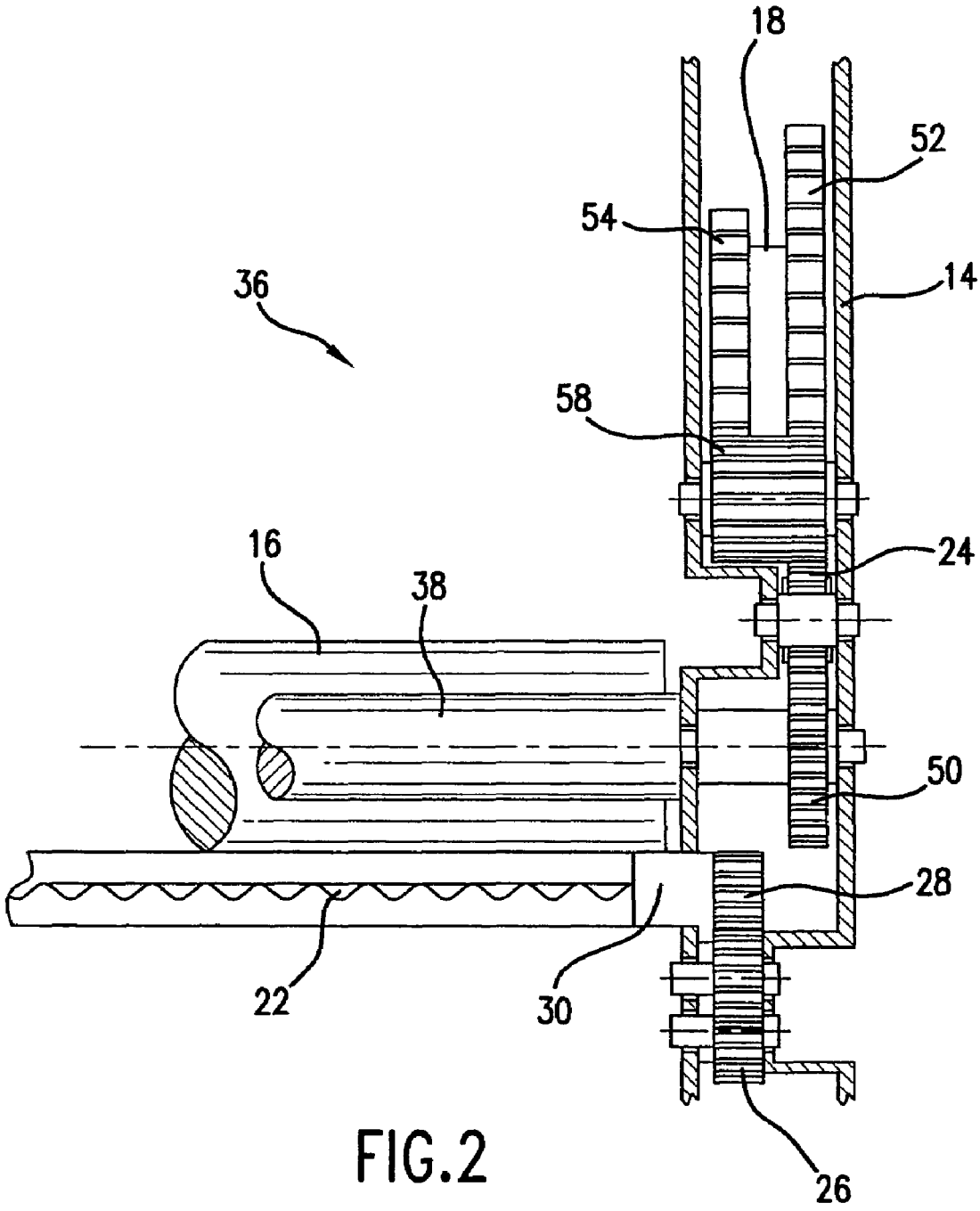
FIG. 2 is a front view of the dispensing mechanism of the dispenser of FIG. 1.

FIGS. 1 and 2 show the dispenser 10 with a dispensing mechanism 36 that is in an at rest or ready to dispense position. The dispenser 10 includes a frame 14 that houses the dispensing mechanism 36 and a roll 34 of sheet material 12. As used herein, the word "frame" is broad enough to cover any structure capable of holding or supporting at least a portion of the dispensing mechanism 36. For example, the frame 14 may include the housing of the dispenser 10. The frame 14 may completely surround the dispenser 10 or may only partially surround the dispenser 10.

The roll 34 may be rotationally mounted on frame 14 in any manner commonly known to those having ordinary skill in the art. For instance, the roll 34 may be a cored roll that rotates on a mandrel disposed therethrough. Alternatively, the roll 34 may be a coreless roll in which a pair of studs may project from frame 14 and engage the roll 34 so that the roll 34 may rotate thereon. Additionally, in accordance with other exemplary embodiments of the present invention, the sheet material 12 need not be placed onto a roll 34, but instead the sheet material 12 is stacked in a folded stock or otherwise in the dispenser 10 to be dispensed therefrom.

As shown in FIG. 1, the sheet material 12 is positioned in a nip between pressure roller 38 and drive roller 16. The pressure roller 38 may be spring biased so as to urge the sheet material 12 against drive roller 16 to hold sheet material 12 with a desired force. Pulling by a user of the sheet material 12 in turn will cause the drive roller 16 to rotate. Additionally, because the sheet material 12 is held against the drive roller 16, rotation of the drive roller 16 will cause the sheet material 12 to be advanced. Although described as being pulled by a user, the dispenser 10 may alternatively be configured as an automatic dispenser such that the drive roller 16 rotates automatically without the need for a user to pull on the sheet material 12. Devices to automatically rotate the drive roller 16 are commonly known to one having ordinary skill in the art.

The frame 14 may include a pair of sheet guides 40 and 42 located beneath the pressure roller 38 and drive roller 16 and through which the sheet material 12 may be advanced. The sheet guides 40, 42 terminate at a discharge opening 44 of the dispenser 10 out of which the sheet material 12 may be positioned during the at rest or ready to dispense position of the dispensing mechanism 36. The sheet guide 40 defines a sheet guide opening 46, and the sheet guide 42 likewise defines a sheet guide opening 48. The sheet guide openings 46, 48 are in line with one another and may be angled in certain exemplary embodiments of the present invention. The purpose of the sheet guide openings 46, 48 is to allow for passage of the cutting blade 22 therethrough in order to cut the sheet material 12 when the dispenser 10 is configured for automatic cutting.

Drive roller 16 is rigidly attached to a drive roller gear 50 that engages a float gear 24. Float gear 24 may be rotated through engagement with a first drive segment 52 of a segmented gear 18. It is to be understood, however, that the float gear 24 is not necessary in accordance with other exemplary embodiments. The first drive segment 52 is used primarily during the dispensing portion of the dispensing cycle while the second drive segment 54 of the segmented gear 18 is used primarily during the automatic advance portion of the dispensing cycle. Although shown as being arc-shaped, the segmented gear 18 may be variously configured in accordance with other exemplary embodiments of the present invention. For instance, segmented gear 18 may be disc-shaped, linear-shaped, or elliptical in accordance with various exemplary embodiments of the present invention. The segmented gear 18 may be a full 360° gear or may be a linear gear such as a gear rack. In accordance with yet another exemplary embodiment, the segmented gear 18 may be a segment gear. The segmented gear 18 is a gear that includes at least two different drive segments. For instance, the segmented gear 18 shown in FIG. 1 includes a first drive segment 52 and a second drive segment 54.

Figure 3:
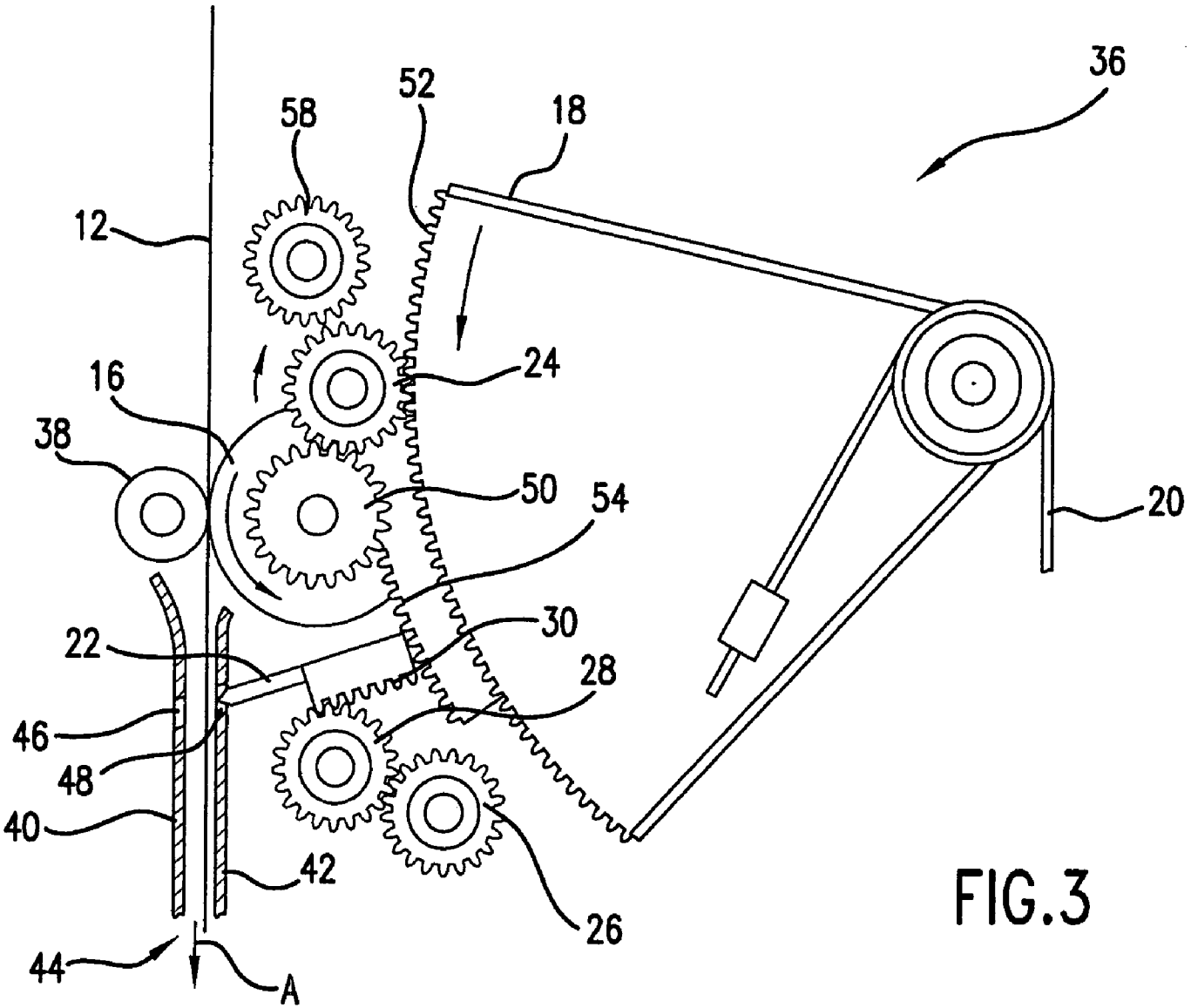
FIG. 3 is a side elevation view of the dispensing mechanism of FIG. 1 shown during the dispense portion of the dispensing cycle.

FIG. 3 shows the dispensing mechanism 36 placed into the dispensing position of the dispensing cycle. In this instance, a user will grasp the sheet material 12 and pull in the direction indicated by arrow A. This action causes the drive roller 16 to rotate in a counterclockwise direction due to the pressure exerted on sheet material 12 by the pressure roller 38. Counterclockwise rotation of the drive roller 16 will result in the counterclockwise rotation of the drive roller gear 50 due to their rigid attachment to one another. The meshing engagement between the drive roller gear 50 and the float gear 24 will result in a clockwise rotation of the float gear 24. This rotation in turn will cause a counterclockwise rotation of the segmented gear 18 due to the meshing of the float gear 24 and the first drive segmented 52 of the segmented gear 18. A spring 20 is in communication with the segmented gear 18 and stores potential energy as the segmented gear 18 rotates in the counterclockwise direction. In accordance with one exemplary embodiment of the present invention, the spring 20 is a torsion spring. It is to be understood, however, that the spring 20 may be variously configured in accordance with other exemplary embodiments of the present invention as is commonly known to one having ordinary skill in the art.

Figure 4:
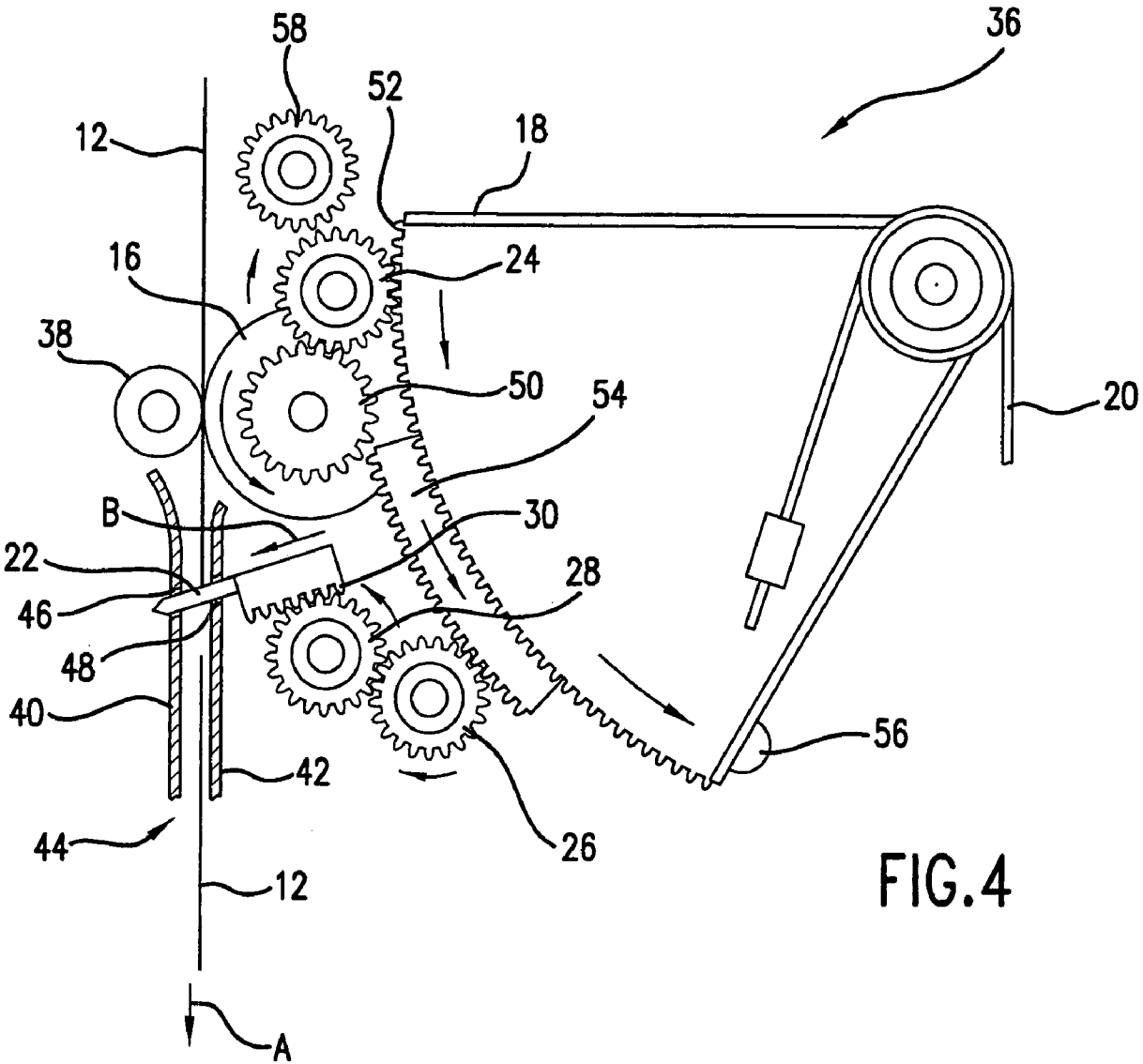
FIG. 4 is a side elevation view of the dispensing mechanism of the dispenser of FIG. 1 shown during the cutting portion of the dispensing cycle.

As the segmented gear 18 rotates in the counterclockwise direction, the second drive segment 54 of the segment gear 18 approaches the cutting blade idler gear 26. Contact between the second drive segment 54 and the cutting blade idler gear 26 will cause a clockwise rotation of the cutting blade idler gear 26 as shown in FIG. 4. Clockwise rotation of the cutting blade idler gear 26 will therefore result in a counterclockwise rotation of the cutting blade drive gear 28 due to their engagement with one another. The cutting blade 22 is provided with a gear rack 30 that engages the cutting blade drive gear 28 so as to form a rack and pinion mechanism. Rotation of the cutting blade gear 28 will result in a movement of the cutting blade 22 in the direction indicated by arrow B. The cutting blade 22 will thus move through sheet guide openings 46, 48 thereby severing the sheet material 12.

Dispenser 10 is also provided with a segmented gear stop 56 that limits the rotational movement of the segmented gear 18 in the counterclockwise direction. In the event the sheet material 12 is not fully severed upon engagement with the cutting blade 22, the segmented gear 18 will contact the segmented gear stop 56 that will in turn cease rotation of the segmented gear 18. This action will also stop rotation of the other components in the dispensing mechanism 36 such as the float gear 24 and the drive roller 16 hence causing a locking of the dispensing mechanism 36. At this point, a restrictive force will be placed against the sheet material 12 that allows a user to fully sever the sheet material 12 by applying additional pulling thereon.

Figure 5:
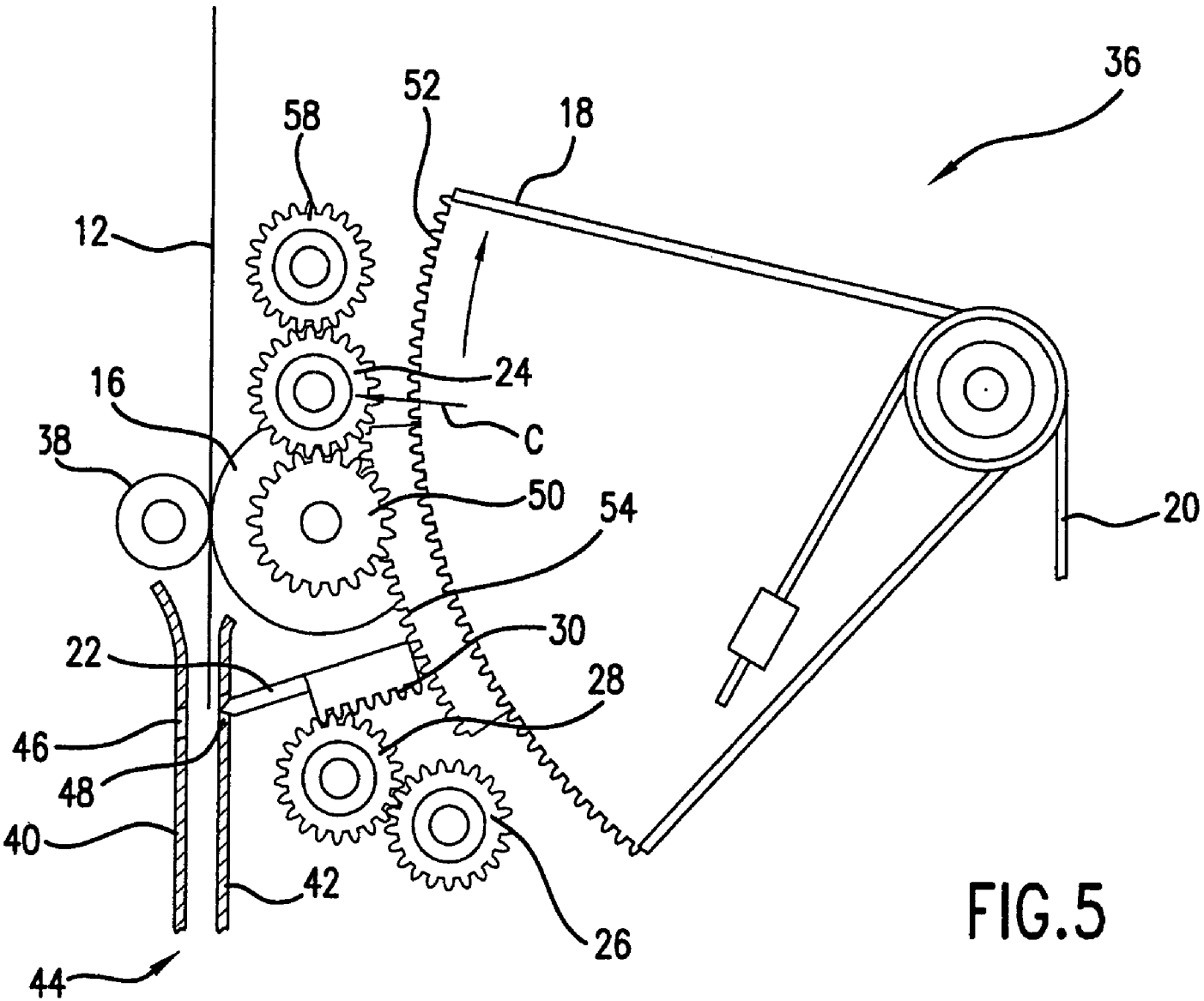
FIG. 5 is a side elevation view of the dispensing mechanism of the dispenser of FIG. 1 shown during a return portion of the dispensing cycle.

Cutting of the sheet material 12 eliminates the force applied by a user to dispense the sheet material 12. This force is thus removed from the drive roller 16 and is no longer transferred to the first drive segment 52 of the segmented gear 18 to store potential energy in the spring 20. The spring 20 will begin to release its stored potential energy due to the removal of force thereon. Release of potential energy in the spring 20 causes the segmented gear 18 to rotate clockwise as shown in FIG. 5. Clockwise rotation of the second drive segment 54 causes the cutting blade idler gear 26 to rotate in a counterclockwise direction that will be translated to the gear rack 30 so as to move the cutting blade 22 back out of the sheet guide openings 46, 48 and into an at rest or ready position as shown in FIGS. 1 and 5.

Figure 6:
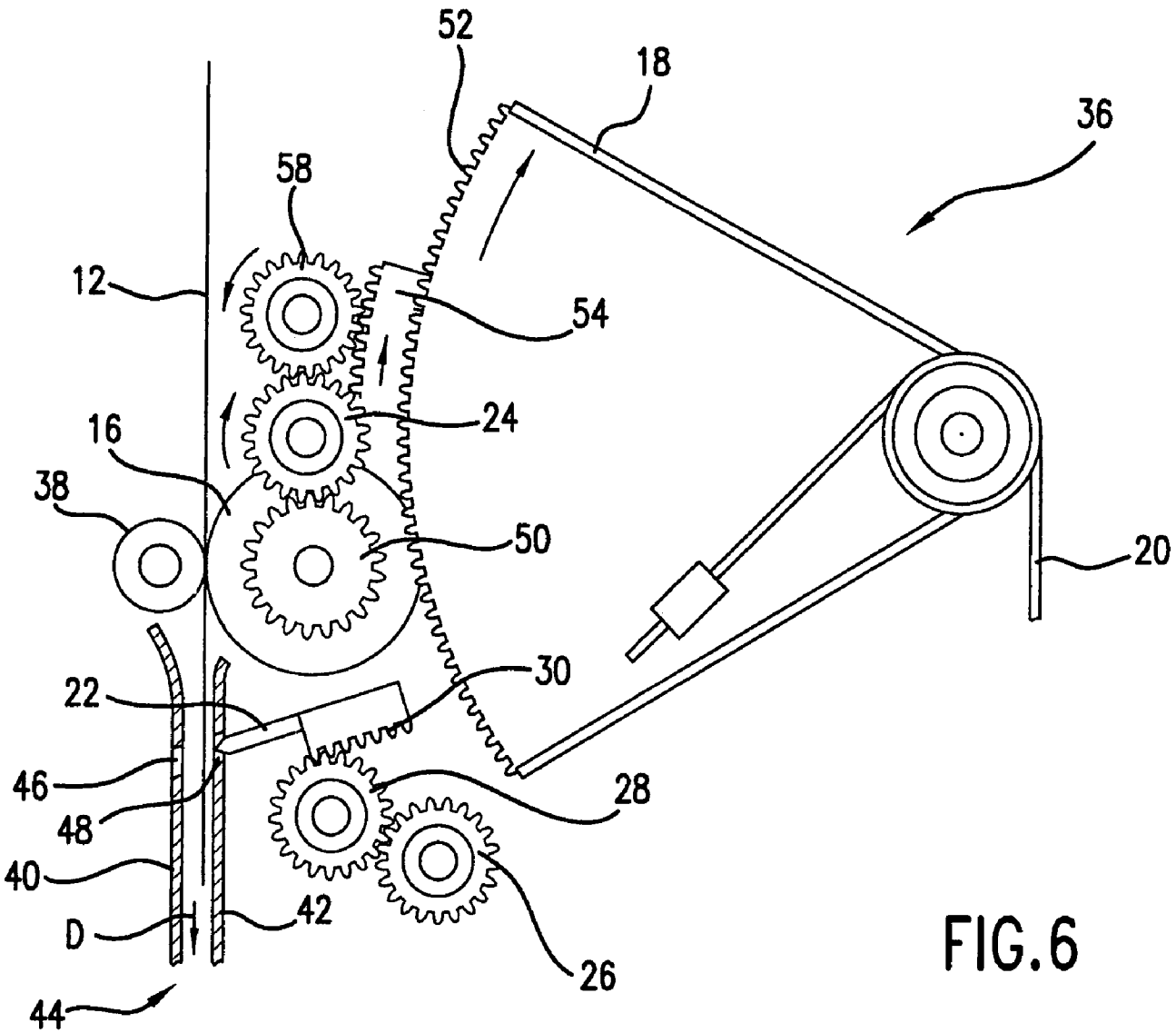
FIG. 6 is a side elevation view of the dispensing mechanism of the dispenser of FIG. 1 shown during an automatic advance portion of the dispensing cycle.

Clockwise rotation of the segment gear 18 will also cause float gear 24 to move out of contact with the first drive segment 52 and into engagement with an idler gear 58. As shown in FIG. 5, the direction of movement of the float gear 24 indicated by directional arrow C. The mechanism responsible for ensuring movement of the float gear 24 will be discussed at a later point in the Detailed Description. FIG. 6 shows the advancement of the segmented gear 18 from the position shown in FIG. 5. Here, the second drive segment 54 contacts the idler gear 58 and causes the idler gear 58 to rotate in the counterclockwise direction. Counterclockwise rotation of the idler gear 58 results in a clockwise rotation of float gear 24. As shown, float gear 24 also engages drive roller gear 50 and causes the drive roller gear 50 to rotate in the counterclockwise direction. As previously discussed, the pressure roller 38 will urge the sheet material 12 against the drive roller 16 and as such rotation of the drive roller 16 through rotation of the drive roller gear 50 will cause the sheet material 12 to be advanced in the direction indicated by directional arrow D. This advancement will cause a portion of the sheet material 12 to be moved out of the discharge opening 44 to be presented to a user.

Figure 7:
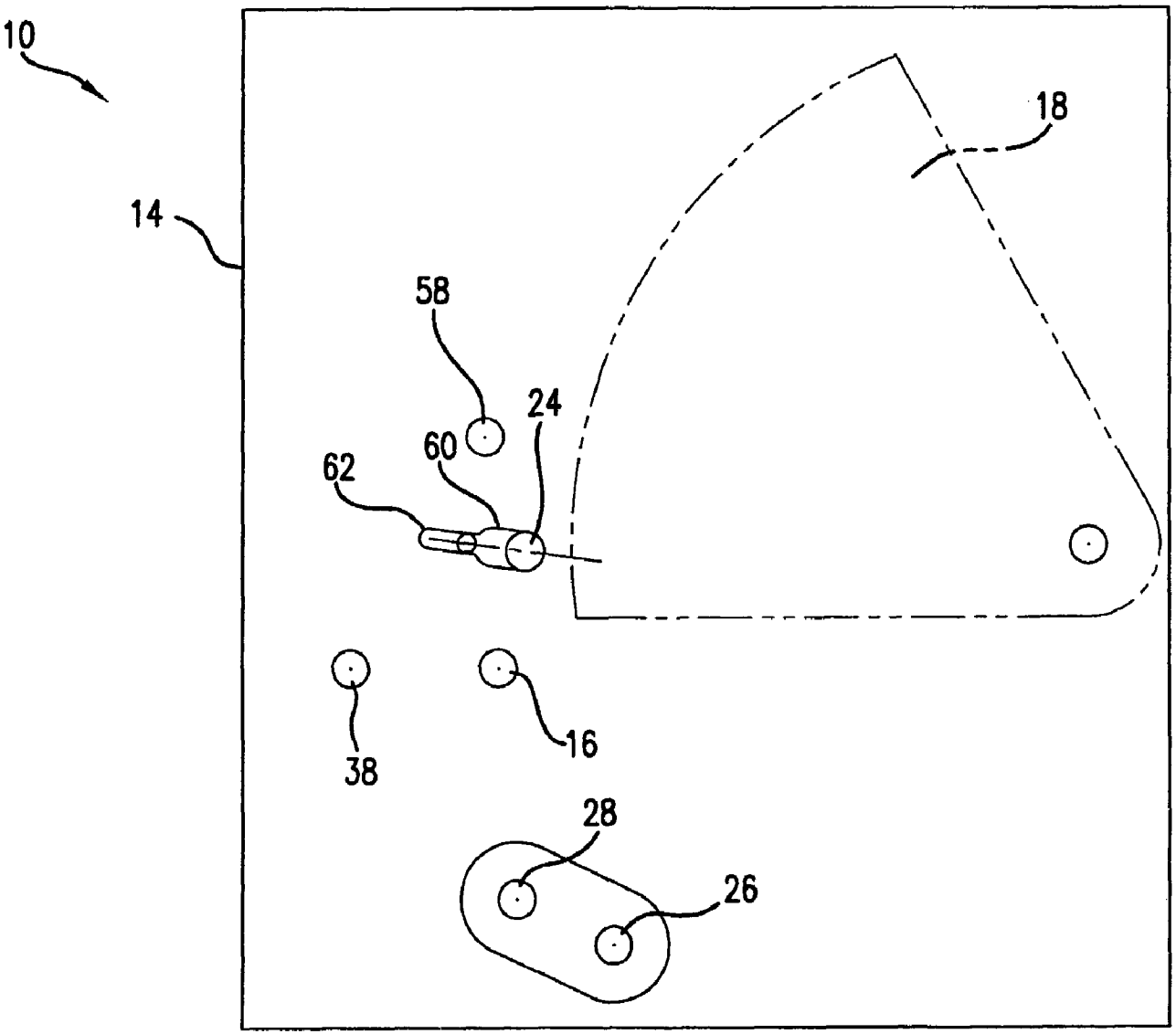
FIG. 7 is a side elevation view of the frame of the dispenser of FIG. 1 that shows a float gear slot in the side of the frame.
Figure 8:
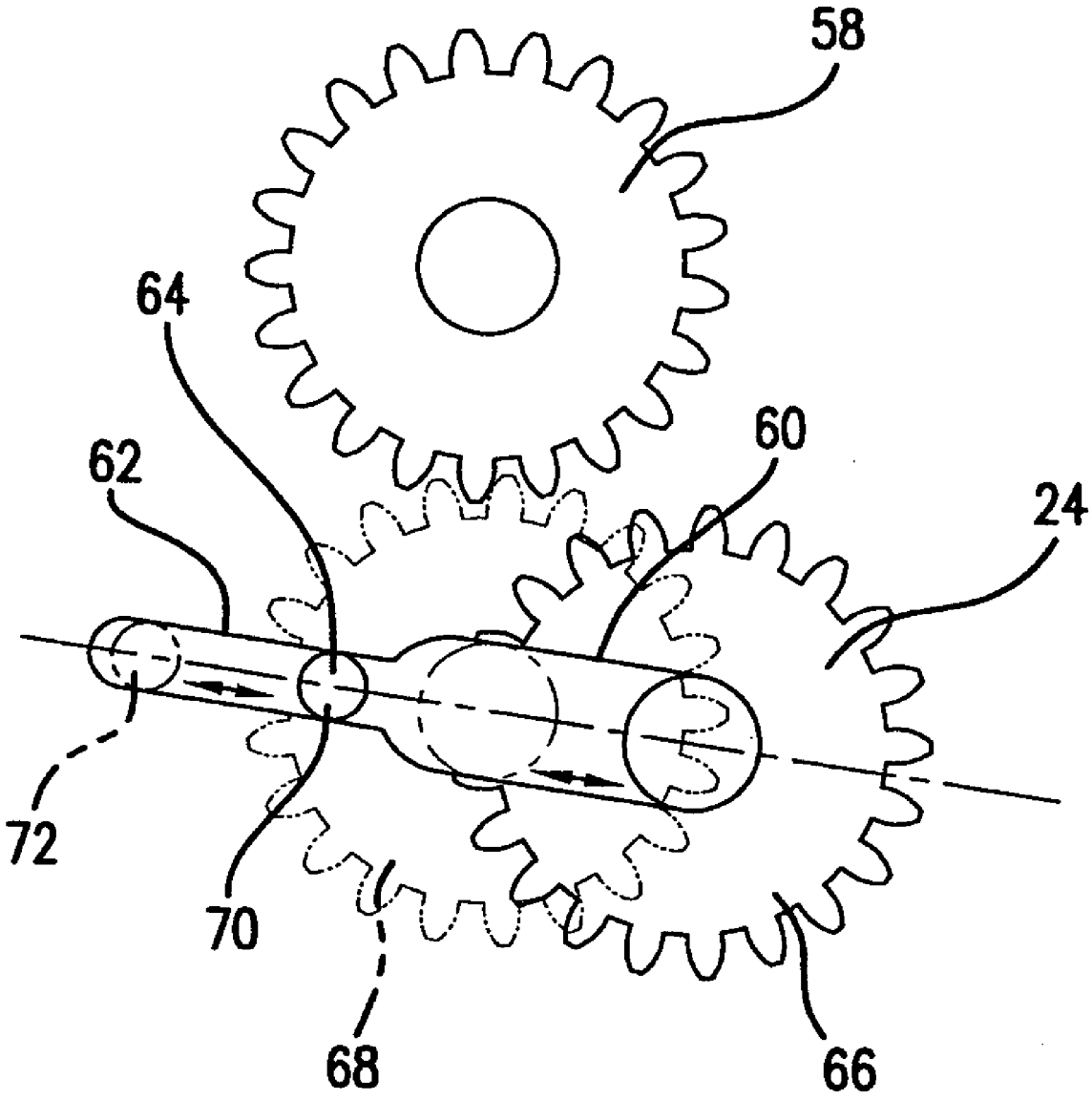
FIG. 8 is an enlarged detail view of the float gear slot, float gear, and related components.

The mechanism used to control movement of the float gear 24 will now be explained in greater detail. Referring to FIG. 7, a portion of the side of frame 14 is shown and includes a float gear slot 60. A guide pin slot 62 is also included and is aligned with the float gear slot 60. FIG. 8 is a detailed view of this portion of dispenser 10. The float gear 24 is shown in an extended position 66 and may be moved back and forth between a retracted position 68 along the float gear slot 60. As shown in the retracted position 68, the float gear 24 engages the idler gear 58 during the automatic advance portion of the dispensing cycle.

Figure 9A:
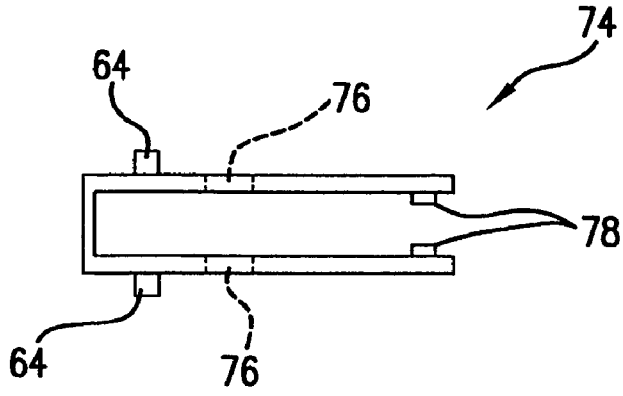
FIGS. 9A-9C are top, side, and front views of the float gear guide of the dispenser of FIG. 1.
Figure 9B:
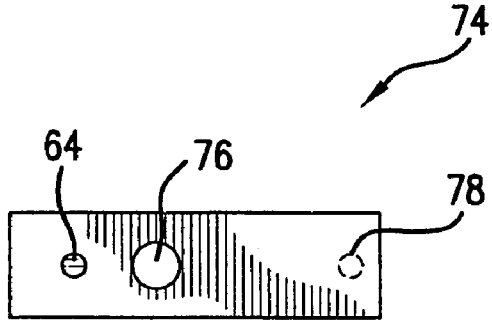
Figure 9C:
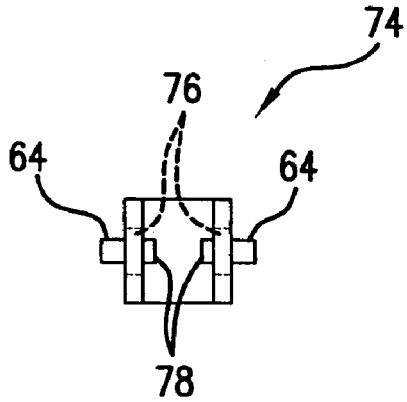

FIGS. 9A-9C show a float gear guide that is a "U"-shaped member that defines a pair of gear mounting holes 76 into which the float gear 24 is mounted. A pair of guide pins 64 and tracking pins 78 are located on the float gear guide 74. The guide pins 64 are located in the guide pin slot 62 as shown in FIG. 8. As shown in FIG. 8, the guide pins 64 may be moved between an extended position 70 at such time the float gear 24 is in the extended position 66, and between a retracted position 72 at such time the float gear 24 is positioned in the retracted position 68. Guide pins 64 therefore act to limit the movement of the float gear 24 to linear motion in the direction along the line of the guide pins slot 62.

Figure 10:
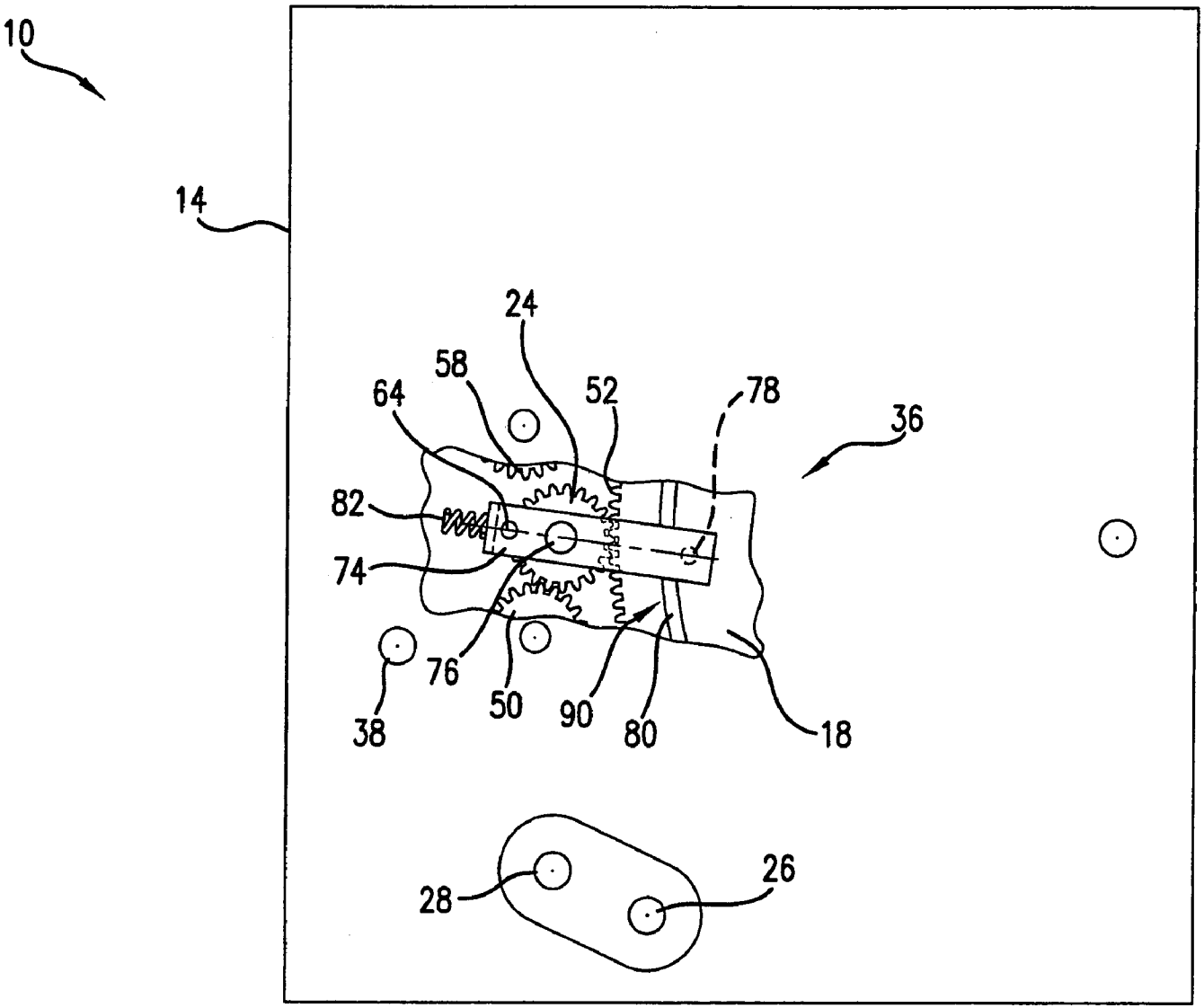
FIG. 10 is a partial cutaway elevation view of the frame of the dispenser of FIG. 1 that shows the float gear and related components.

FIG. 10 shows the frame 14 with a cutaway portion in order to view a section of the dispensing mechanism 36 contained therein. The tracking pins 78 work in conjunction with a pair of tracking ribs 80 located on the segmented gear 18. FIG. 10 shows the dispensing mechanism 36 in the dispensing position and as such the float gear 24 is in engagement with the first drive segment 52, and the tracking pins 78 are located on the right hand side of the tracking ribs 80.

During clockwise rotation of the segment gear 18, the tracking pins 78 ride along the right hand side of the tracking ribs 80. A float gear guide spring 82 is positioned on the left hand side of the float gear guide 74 and urges the float gear guide 74 towards the segmented gear 18 such that the float gear 24 is urged towards the first drive segment 52. The float gear guide spring 82 acts to urge the float gear guide 74 towards the segment gear 18 to help ensure release from idler gear 58 following the automatic advance portion of the dispensing cycle. The combination of the float gear guide 74, float gear guide spring 82, tracking pins 78, and tracking ribs 80 serves to ensure proper release and engagement of float gear 24 with the first drive segment 52 and the idler gear 58.

Figure 11:
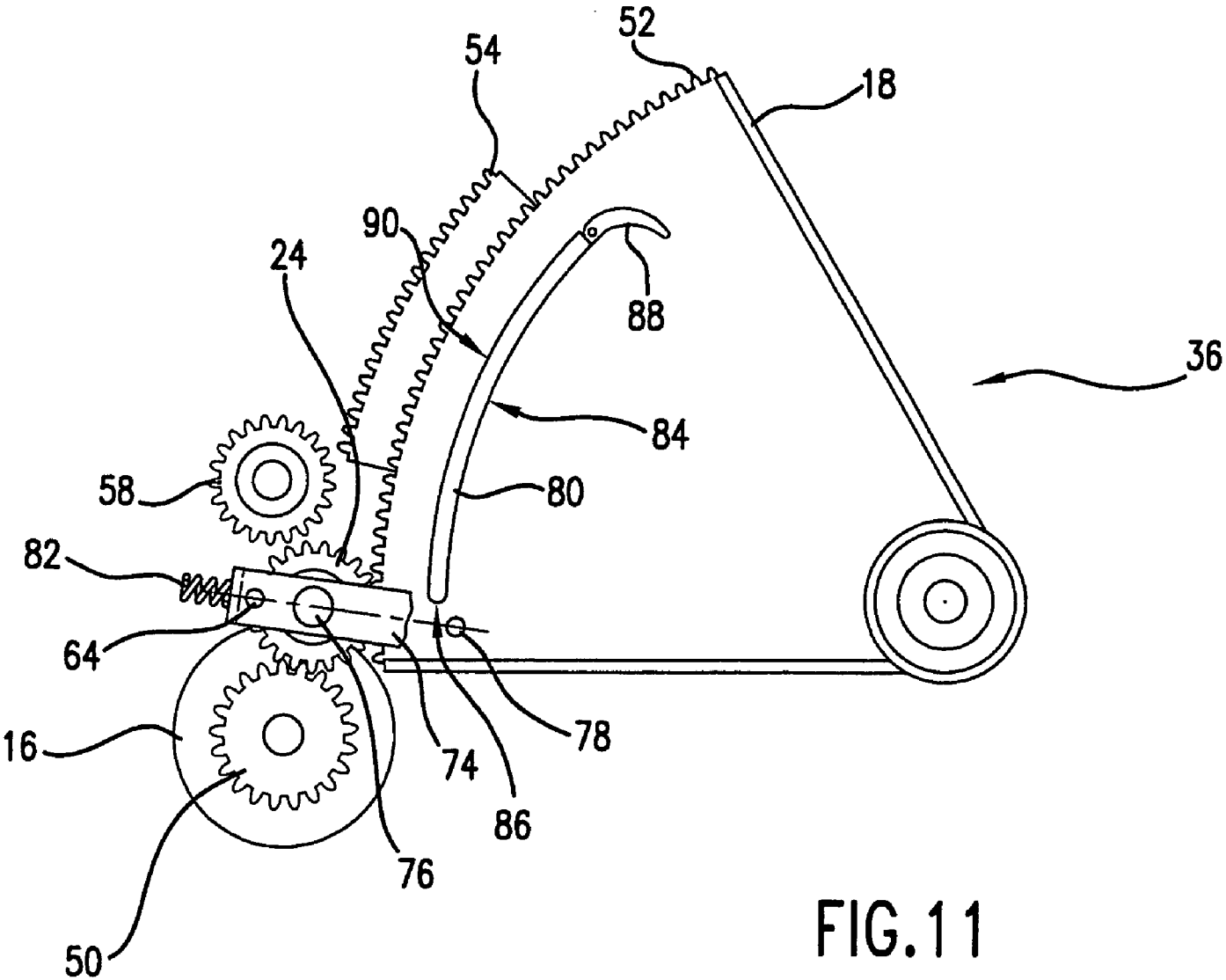
FIG. 11 is an elevation view of the dispensing mechanism of the dispenser of FIG. 1 that shows a tracking rib located on the segment gear and a tracking pin located on the float gear guide.

FIG. 11 shows the segmented gear 18 in the at rest or ready position. Here, the float gear 24 is urged forwardly by the float gear guide spring 82 so as to be in contact with the first drive segment 52. The tracking pin 78 is positioned rearward of an inside face 84 of the tracking rib 80. Also, the tracking pin 78 is positioned a distance below the lower most point 86 of tracking rib 80 so as to help ensure a return to the ready position of the tracking pin 78 before completion of the return or automatic dispense portion of the dispensing cycle. As the segmented gear 18 rotates counterclockwise during the dispensing portion of the dispensing cycle, the inside face 84 of the tracking rib 80 travels forward of the tracking pin 78 so as to help ensure engagement between the float gear 24 and the first drive segment 52.

Figure 13:
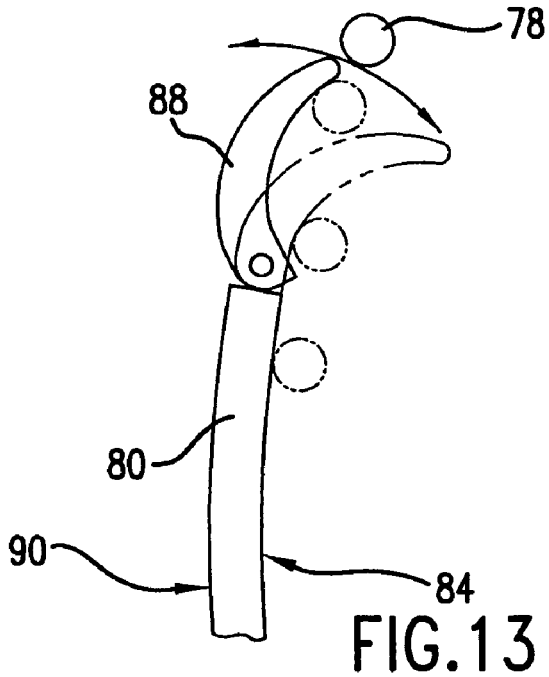
FIG. 13 is a detailed side elevation view of the tracking rib of the dispenser of FIG. 1 that shows pivoting of the tracking pin lockout member in order to allow the tracking pin to pass thereby.

As the segmented gear 18 continues to rotate in the counterclockwise direction the tracking rib 80 will move past the tracking pin 78 so that a tracking pin lockout member 88 passes the tracking pin 78. Engagement of the tracking pin lockout member 88 with the tracking pin 78 causes the tracking pin lockout member 88 to pivot so as to allow the tracking pin lockout member 88 to pass the tracking pin 78. This pivoting action is illustrated in FIG. 13 that shows the relative position of the tracking pin lockout member 88 and the tracking pin 78 as the tracking rib 80 rotates in the counterclockwise direction.

Once the tracking pin lockout member 88 has passed the tracking pin 78, the tracking pin lockout member 88 is free to return to its original position either via gravity, spring pressure, or a combination of the two. The tracking pin lockout member 88 is designed so as to have a lower geometry that allows the tracking pin lockout member 88 to pivot only through the arc shown in FIG. 13. The left side of the tracking pin lockout member 88 has a radius that allows the tracking pin lockout member 88 to pivot to the left. A portion of the tracking pin lockout member 88 is flat and will contact the tracking rib 80 to prevent the tracking pin lockout member 88 from pivoting to the right from its at rest position.

Figure 14:
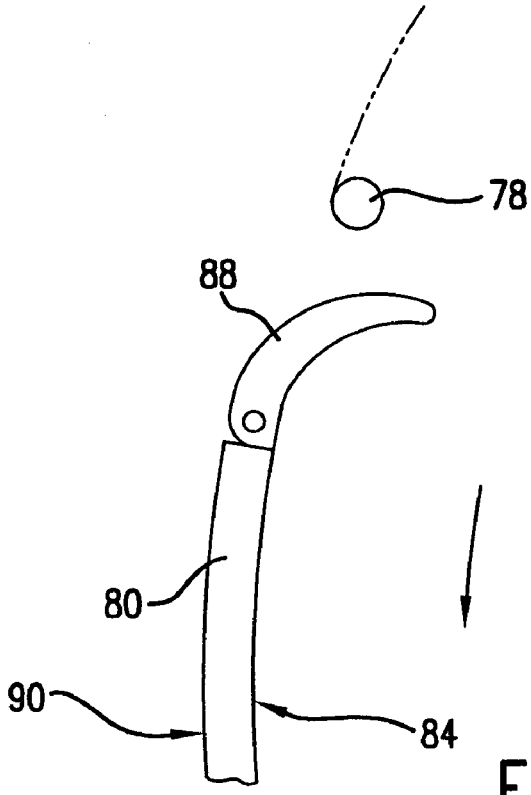
FIG. 14 is a detailed side elevation view of the tracking rib of the dispenser of FIG. 1 that shows the relative position between the tracking pin lockout member and the tracking pin once the segmented gear has completed its full counterclockwise travel.

FIG. 14 shows the relative positioning of the tracking rib 80, tracking pin lockout member 88, and the tracking pin 78 once the segmented gear 18 has completed its full counterclockwise rotation and has contacted the segmented gear stop 56 (FIG. 4). These components may be configured so to allow for additional rotational travel beyond the location in which the tracking pin lockout member 88 clears tracking pin 78 and completion of counterclockwise rotation of the segmented gear 18. This amount of rotational distance helps ensure the appropriate relative positions of the tracking pin 78 and tracking pin lockout member 88 should the sheet material 12 sever prior to the complete counterclockwise travel of segmented gear 18.

Figure 12:
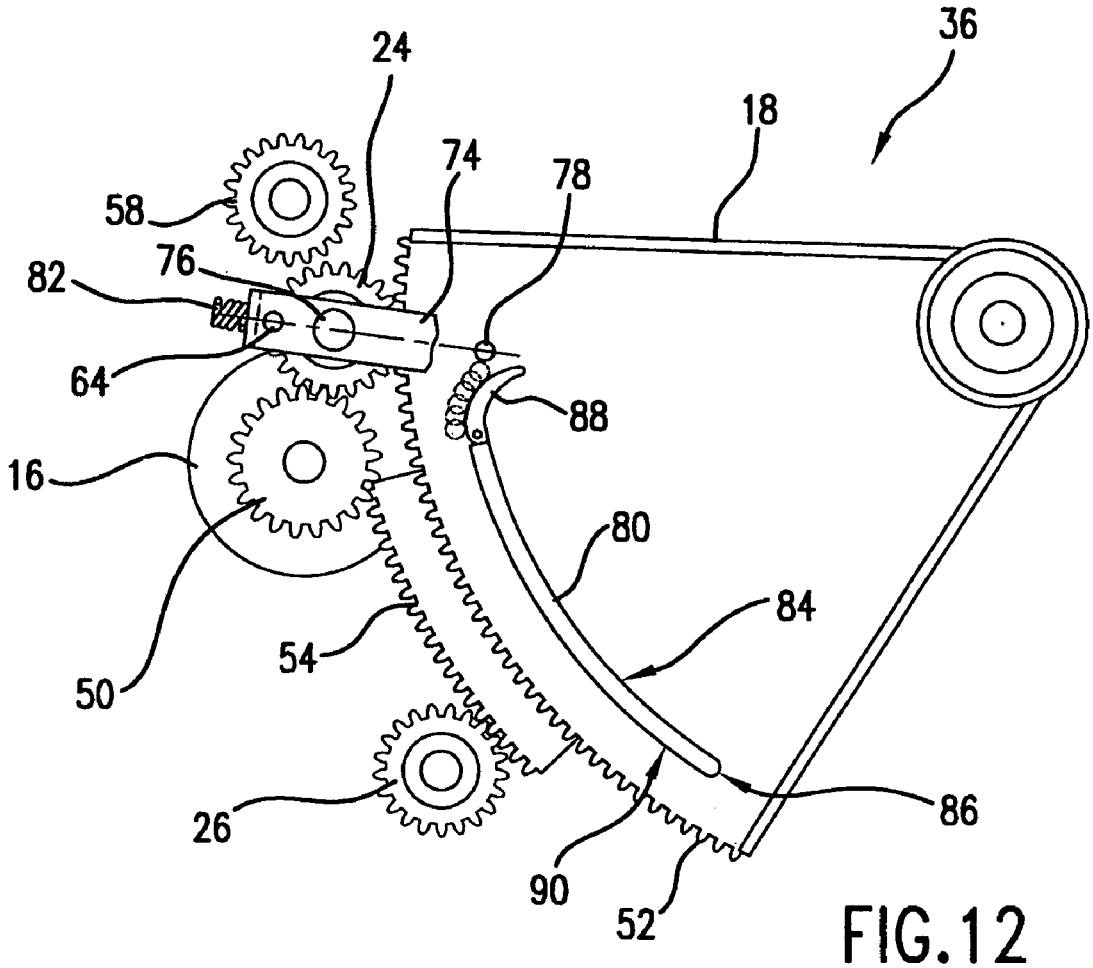
FIG. 12 is a side elevation view of the dispensing mechanism of the dispenser of FIG. 1 shown during a return portion of the dispensing cycle that shows the interaction between the tracking pin and a lockout member of the tracking rib.
Figure 15:
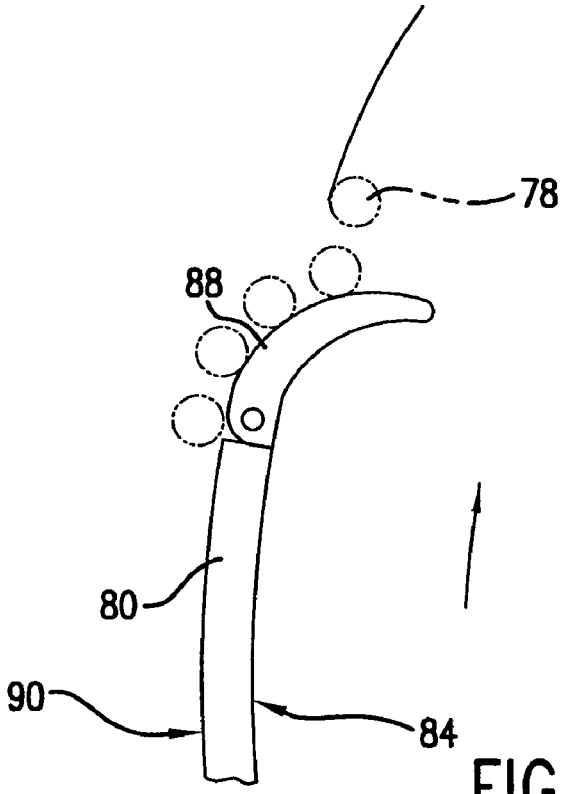
FIG. 15 is a detailed side elevation view of the tracking rib of the dispenser of FIG. 1 that shows the relative position between the tracking pin lockout member and the tracking pin when the segmented gear is moved during the automatic dispense portion of the dispensing cycle.

FIGS. 12 and 15 show the relative relationship of the tracking pin lockout member 88 and tracking rib 80 to the tracking pin 78 during the advance portion of the dispensing cycle. As the segment gear 18 rotates clockwise during the advance portion of the dispensing cycle the tracking pin lockout member 88 will encounter the tracking pin 78. The tracking pin lockout member 88 will prevent the inside face 84 of the tracking rib 80 from traveling in front of the tracking pin 78. Upon contract with the tracking pin lockout member 88, the tracking pin 78 and thus the entire float gear guide 74 will be urged forward in the float gear slot 60 to the retracted position 72. This forward movement ensures disengagement of the float gear 24 from the first drive segment 52 and in turn causes engagement of the float gear 24 with the idler gear 58. As the segmented gear 18 continues to rotate in the clockwise direction, the outside face 90 of the tracking rib 80 is maintained behind the tracking pin 78 thereby ensuring continued contact between float gear 24 and idler gear 58.

Figure 16:
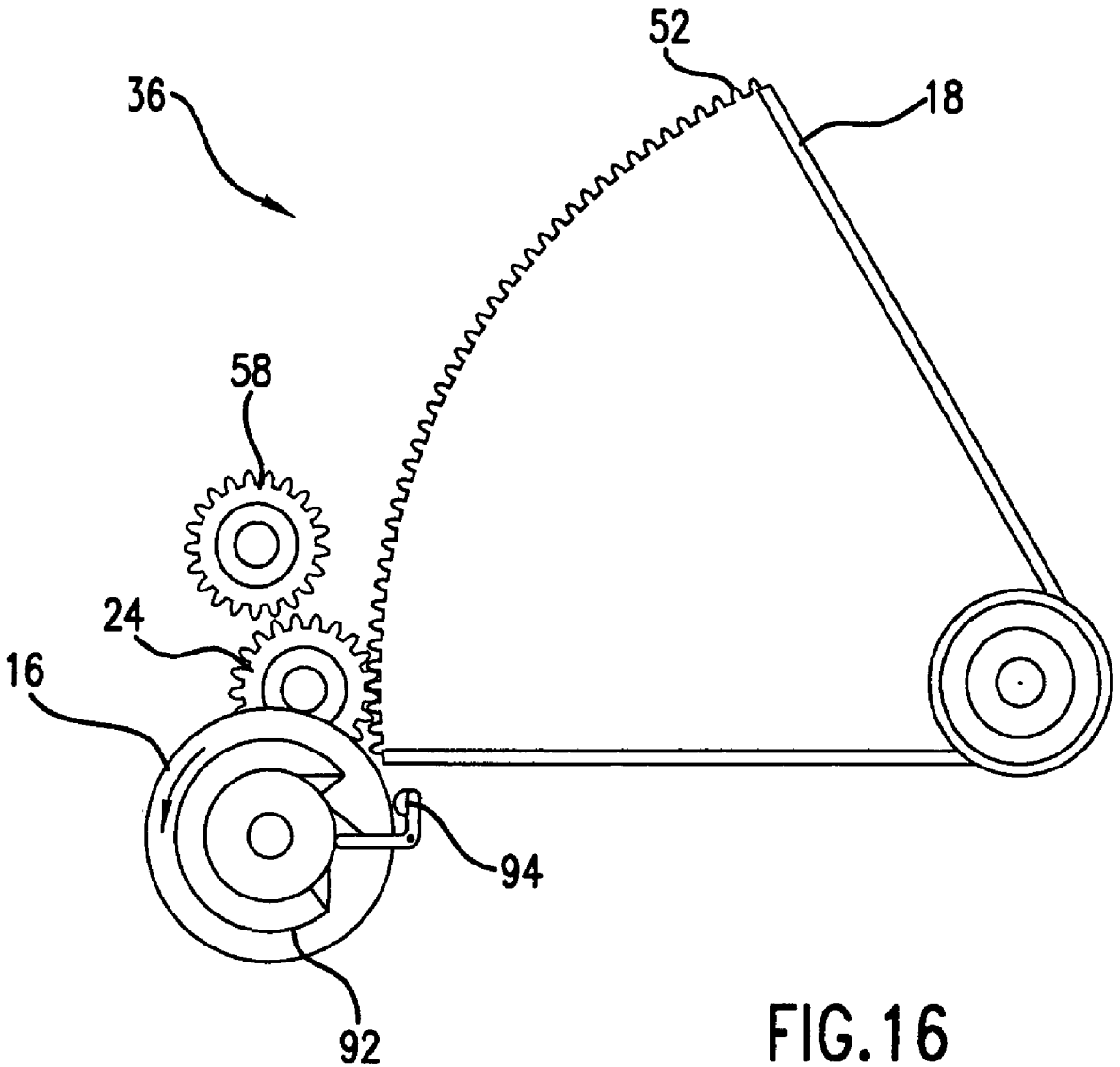
FIG. 16 is a side elevation view of an alternative embodiment of the dispenser in accordance with the present invention in which the dispensing mechanism is provided with a locking ratchet to prevent inadvertent rewind of sheet material.

The possibility exists that the sheet material 12 could be released prior to the completion of dispensing. For example, the user may release the sheet material 12 prior to the time in which the sheet material 12 is cut by the cutting blade 22. Additionally, in some instances a small portion of the sheet material 12 may rip away from the main portion of the sheet material 12 as may be the case if the user pulls the sheet material 12 over a small surface area such as between his or her thumb and forefinger. Such a release of the sheet material 12 may cause a reversal of the dispensing mechanism 36 due to the storage of some amount of potential energy in the dispending mechanism 36. This release could result in drawing of the sheet material 12 back into the interior of the frame 14. In accordance with one exemplary embodiment of the present invention, a locking ratchet 92 as shown in FIG. 16 may be provided, preferably adjacent to the drive roller gear 50. A ratchet pawl 94 may also be included in order to prevent inadvertent rewinding of the sheet material 12 since the ratchet pawl 94 would engage the locking ratchet 92 at discrete intervals based on the number of teeth in the locking ratchet 92.

Figure 17:
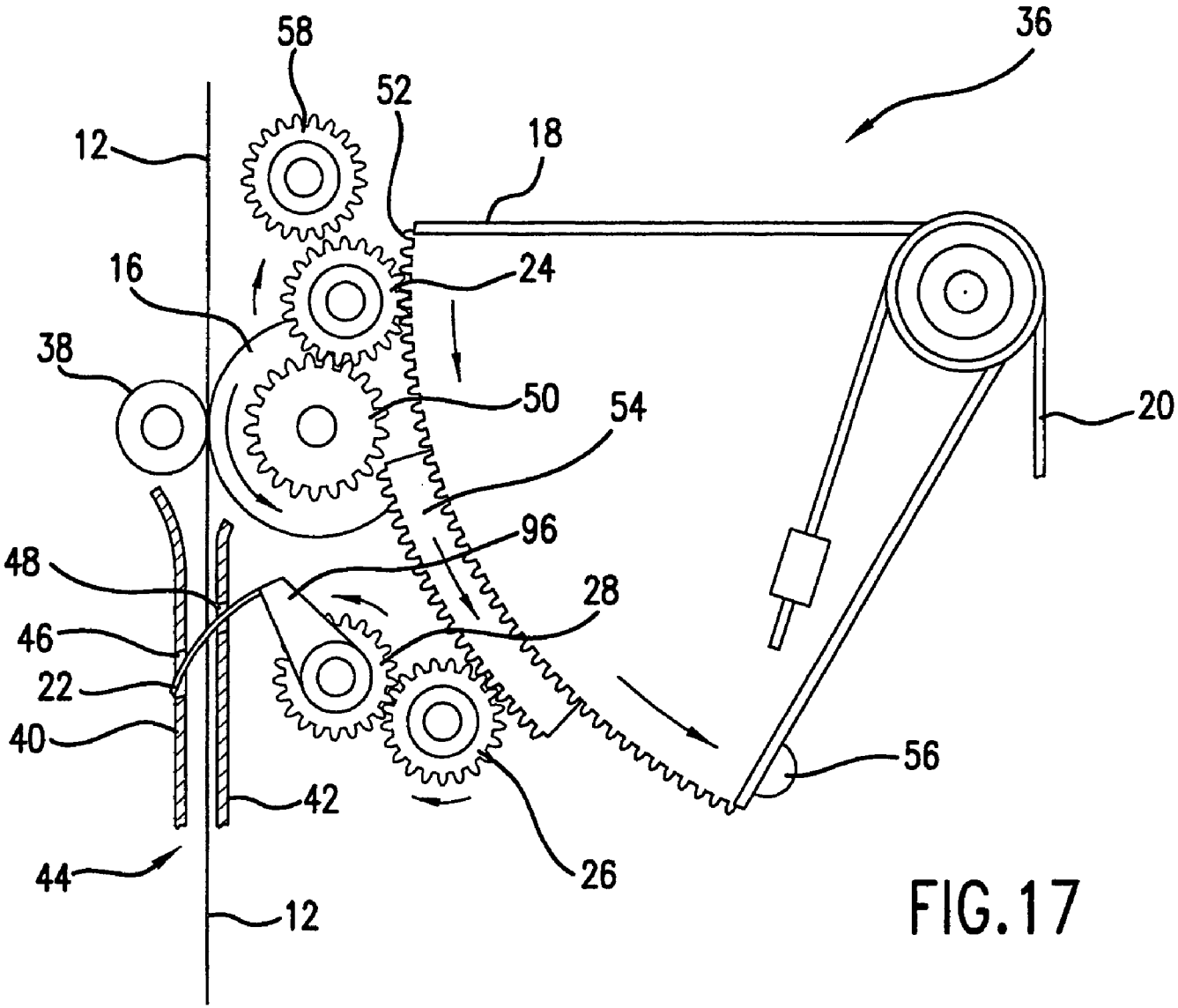
FIG. 17 is a side elevation view of an alternative exemplary embodiment of the dispenser in accordance with the present invention. Here, the cutting blade is rotationally mounted onto a blade drive gear.
Figure 18:
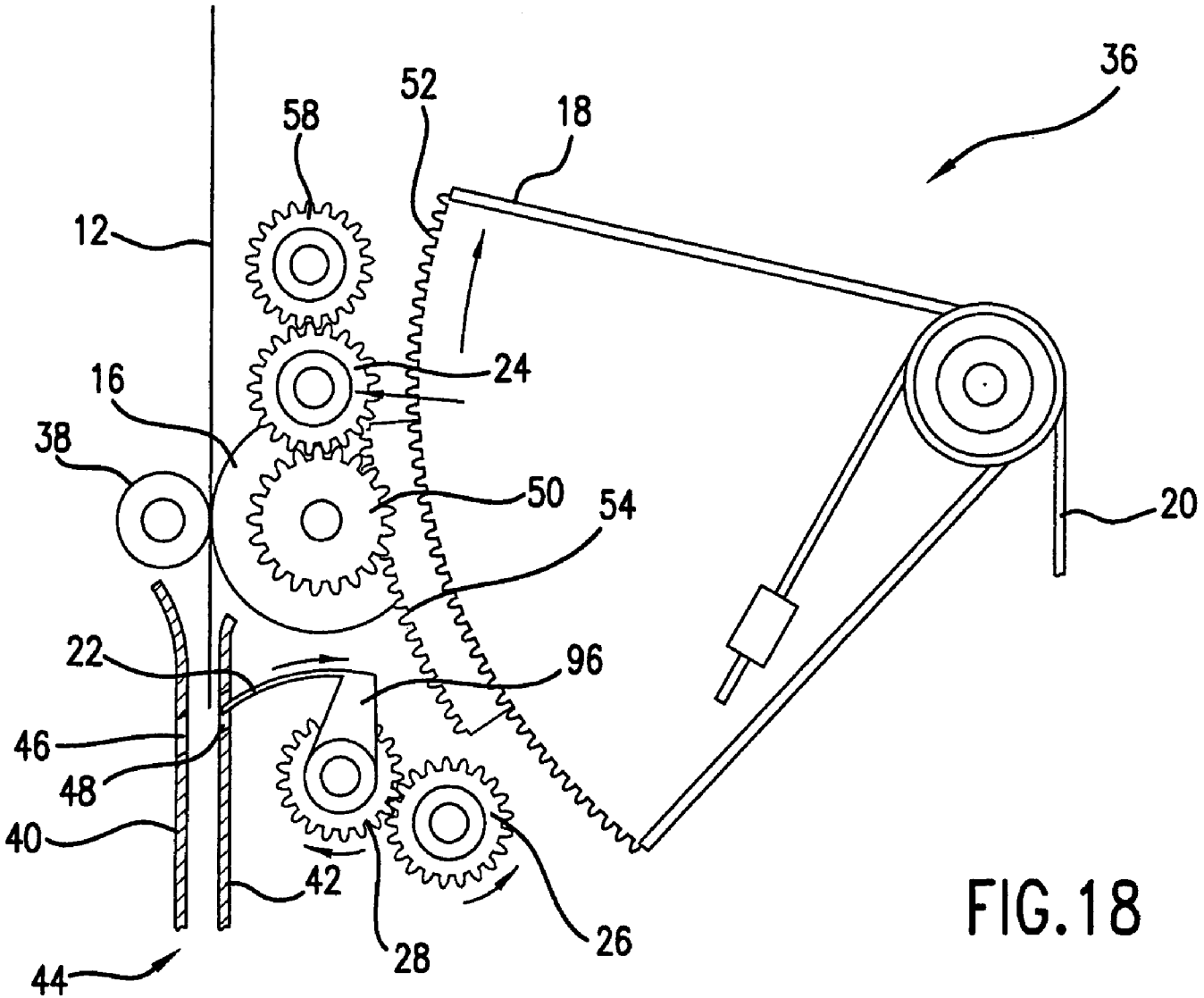
FIG. 18 is a side elevation view of the dispensing mechanism of FIG. 17 that shows the cutting blade rotated out of a sheet guide opening.

FIG. 17 shows an alternative exemplary embodiment of the dispenser 10 in which the cutting blade 22 is rigidly attached to the cutting blade drive gear 28 by way of a blade carrier 96. In this exemplary embodiment, the cutting blade 22 is curved, although the cutting blade 22 may be straight or may be variously shaped in accordance with other exemplary embodiments of the present invention. Contact of the cutting blade idler gear 26 with second drive segment 54 will cause the cutting blade drive gear 28 to rotate clockwise thus moving the cutting blade 22 through the sheet guide openings 46, 48 in order to cut the sheet material 12. Opposite movement of the second drive segment 54 will in turn cause the cutting blade drive gear 28 to rotate clockwise as shown in FIG. 18 so as to retract the cutting blade 22 from the sheet guide openings 46, 48.

In accordance with one exemplary embodiment of the present invention, the drive roller gear 50 is 1.5 inches in diameter, thus yielding 4.71 inches of linear travel per revolution. The dispenser 10 may be configured so that the cutting blade 22 is located 1.25 inches above the dispensing opening 44. The dispenser 10 may be configured so that 2.5 inches of the sheet material 12 is presented to the user at the start of the dispensing cycle. A required advance of 3.75 inches is needed should the dispenser 10 be arranged in this manner. Likewise, if a total sheet material 12 delivery of 11 inches is desired, the dispensed length must be 7.25 inches. With the gear ratios shown in FIG. 1, 1.53 revolutions of drive roller 16 are required in order to deliver the proper dispensed length of the sheet material 12. This amount of dispensing equates to 58 degrees of rotation of the first drive segment 52. In order to provide additional gearing on either side of the working area, the segmented gear 18 is made to be 75 degrees. Likewise, 30 degrees of rotation of the second drive segment 54 is needed in order to provide the correct automatic advance length of the sheet material 12, thereby providing a dwell time between the cutting of the sheet material 12 and advancement of the next piece of sheet material 12. Movement of the cutting blade 22 to sever the sheet material 12 requires 6 degrees of rotation. These 6 degrees may be part of the 30 degrees of the second drive segment 54.

The previously discussed lengths, degrees, and gear ratios are only one possibility in accordance with one exemplary embodiment of the dispenser 10 in accordance with the present invention. The present invention includes numerous other configurations of drive roller diameter, gear ratios, dispensing lengths, etc. as may be commonly known to one having ordinary skill in the art. For instance, the dispended length of the sheet material 12 may be up to 1 inch or may be between 8-12 inches in accordance with other exemplary embodiments.

FIGS. 19-24 show an alterative exemplary embodiment of the dispenser 10 in accordance with the present invention. Here, as with previously described exemplary embodiments, the sheet material 12 is cut and the dispenser 10 automatically advances a new section of sheet material 12 to be presented to the user so that the user does not have to touch other components of the dispenser 10 or other portions of the sheet material 12.

Figure 20:
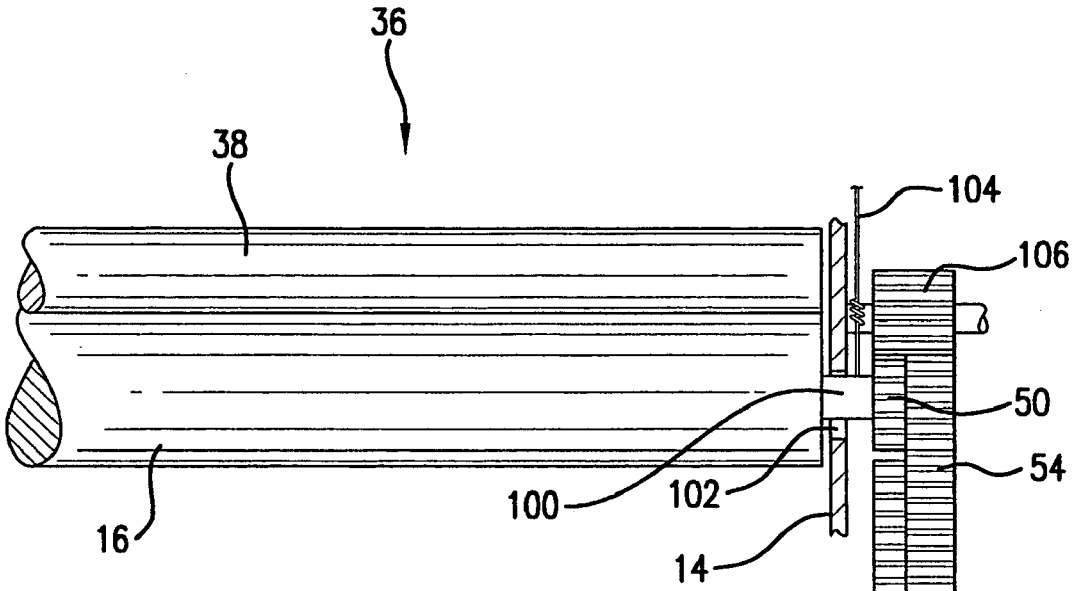
FIG. 20 is a partial front elevation view of the dispensing mechanism of the dispenser of FIG. 19.
Figure 19:
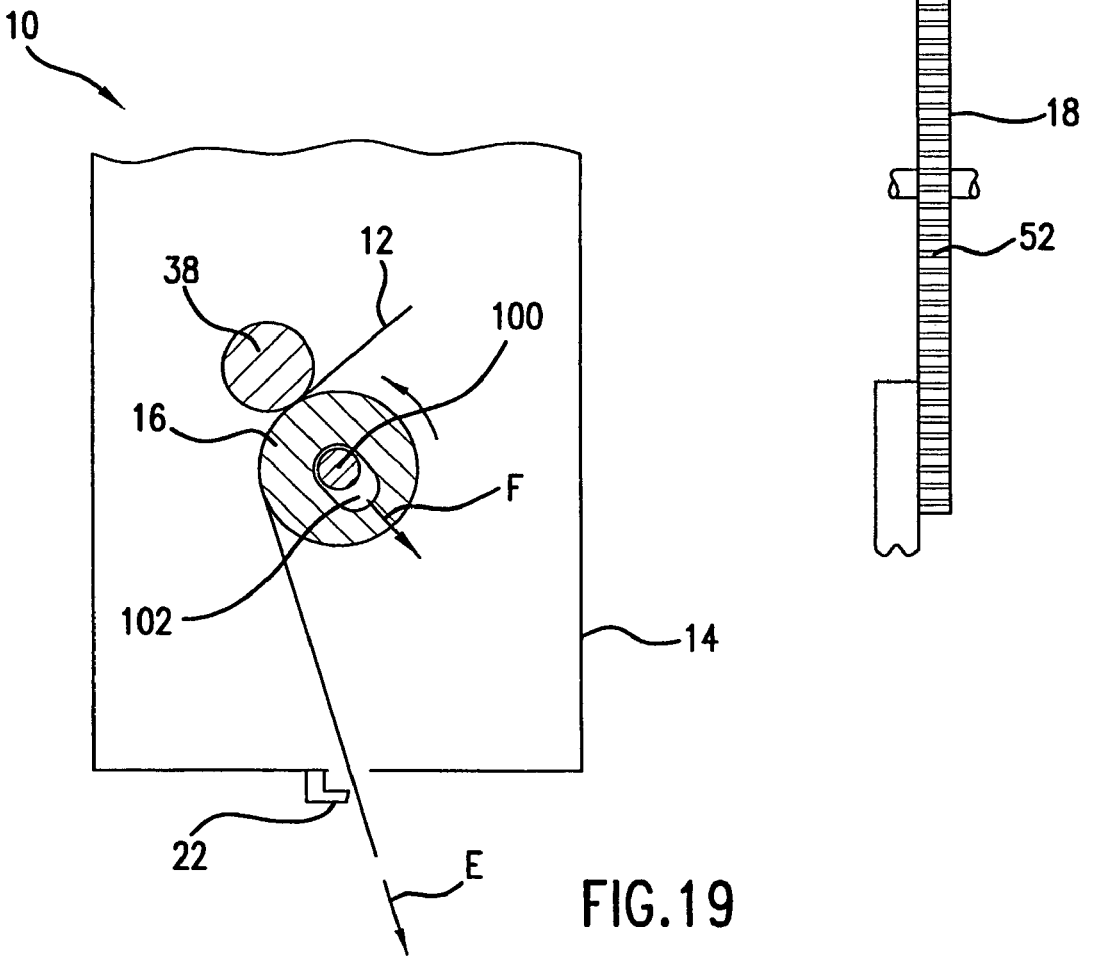
FIG. 19 is a detailed elevation view of a dispenser in accordance with an alternative exemplary embodiment of the present invention in which the drive roller is rotationally and slideably mounted to the frame.

Referring to FIG. 19, the sheet material 12 is urged against the drive roller 16 by way of the pressure roller 38 in a manner as discussed with previous exemplary embodiments. In this exemplary embodiment, however, a drive roller shaft 100 of the drive roller 16 is mounted in an elongated slot 102 of frame 14 so that the drive roller 16 is moveable in the direction of the slot 102. As such, the drive roller 16 is both rotationally and slideably mounted to the frame 14. As shown in FIG. 20, a spring 104 is provided and is used to urge the drive roller 16 to an at rest position in the uppermost portion of the slot 102 as shown in FIG. 19. As sheet material 12 is withdrawn in the direction indicated by directional arrow E, frictional forces between the sheet material 12 and the drive roller 16 cause the drive roller 16 to rotate counterclockwise. Further, as the sheet material 12 is pulled by a user, a force component is exerted on the drive roller 16 so as to urge the drive roller 16 towards the lowermost portion of the slot 102 as shown in accordance with directional arrow F.

Referring now to FIGS. 19-22, the teeth of the drive roller gear 50 will engage the teeth of the first drive segment 52 of segmented gear 18 as a user pulls on the sheet material 12 and hence moves the drive roller 16 to the lowermost portion of slot 102. This engagement will cause the segmented gear 18 to rotate clockwise, as shown for instance in FIG. 22. As with previously discussed exemplary embodiments, the segmented gear 18 is spring loaded so as to store potential energy when a user pulls on the sheet material 12. Again, the spring 20 used to store potential energy may be a torsion spring or any other spring commonly known to one having ordinary skill in the art. The segmented gear 18 may be configured so as to rotate until it contacts a fixed stop (not shown) on the frame 14. Rotation of the segmented gear 18 and the location of the fixed stop (not shown) determine the amount of sheet material 12 that can be withdrawn from the dispenser 10. This follows from the fact that the stopping of rotation or movement of segmented gear 18 will also prevent movement of the drive roller 16 and hence prevent sheet material 12 from being withdrawn therefrom.

Once the segmented gear 18 has rotated to its design limit, the user may pull the sheet material 12 against the cutting blade 22. As shown in FIG. 19 the cutting blade 22 is a stationary cutting blade and is attached to the frame 14. It is to be understood that in accordance with other exemplary embodiments of the present invention that the cutting blade 22 need not be attached to the frame 14 but may be attached, for instance, to some other structure. As such, the present invention includes exemplary embodiments in which the cutting blade 22 is both an automatic cutting blade and/or a stationary cutting blade.

Cutting of the sheet material 12 removes the force component that urges the drive roller 16 to the lowermost portion of slot 102 and thereby allows the drive roller 16 to return to the uppermost portion of slot 102. In this position, drive roller gear 50 will be placed into contact with a stationary gear 106 and out of contact with the first drive segment 52. Since the drive roller gear 50 is no longer in contact with the segmented gear 18, the segmented gear 18 is free, via stored spring energy, to rotate counterclockwise to its at rest position as shown for instance in FIG. 21. The second drive segment 54 may come into contact with the stationary gear 106 during the last one third of travel of the segmented gear 18. Engagement with the stationary gear 106 by the second drive segment 54 will cause the stationary gear 106 to rotate clockwise as shown for instance in FIG. 21. Stationary gear 106 is in engagement with the drive roller gear 50 and will therefore cause a counterclockwise rotation of the drive roller gear 50 and will hence cause a counterclockwise rotation of the drive roller 16.

Figure 22:
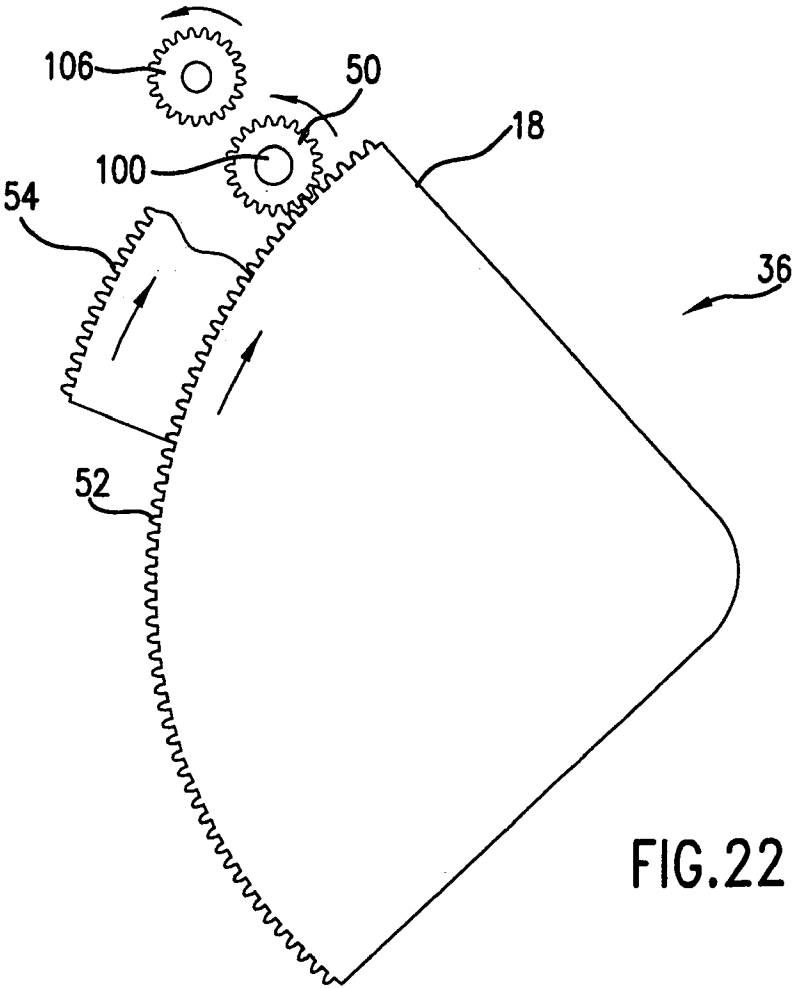
FIG. 22 is a side elevation view of the segmented gear and related components of the dispenser of FIG. 19 shown during the dispensing portion of the dispensing cycle.
Figure 21:
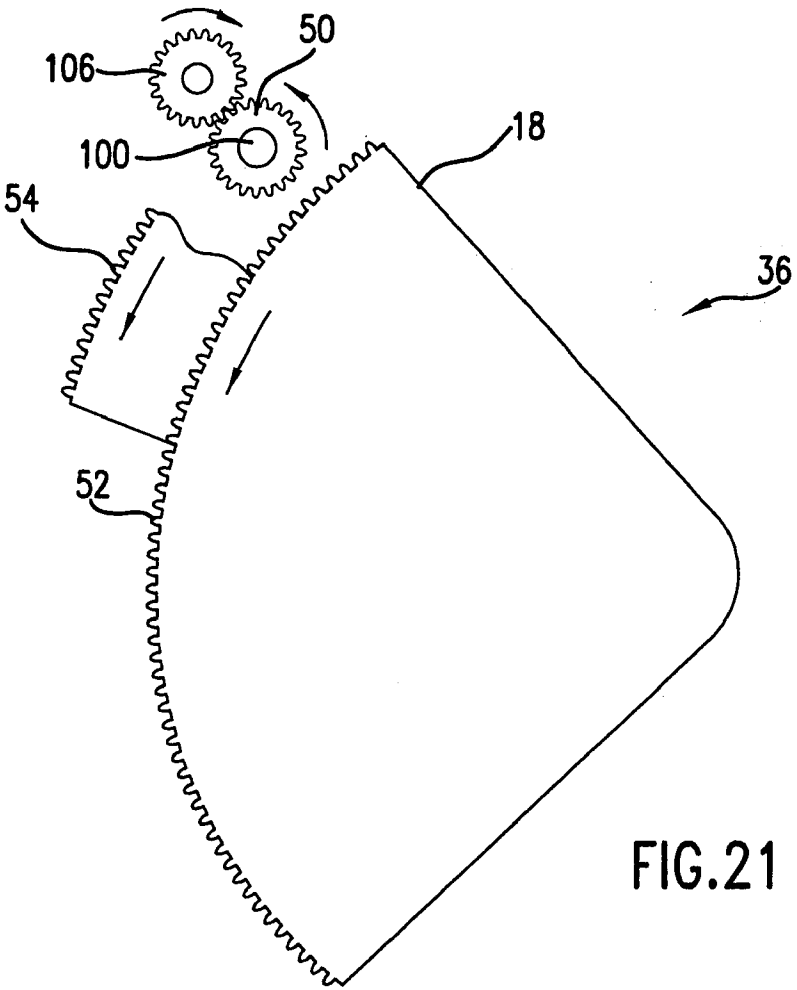
FIG. 21 is a side elevation view of the segmented gear and related components of the dispenser of FIG. 19 shown during the automatic advance portion of the dispensing cycle.

Counterclockwise rotation of the drive roller 16 will result in an advancement of the sheet material 12 so as to present a new piece of sheet material 12 to the user for future removal. The exemplary embodiment of the dispenser 10 in FIGS. 19-22 is designed so that during the return portion of the segmented gear 18 the drive roller 16 will make one revolution thereby resulting in the advancement of approximately 3 inches of sheet material 12. As shown in FIGS. 21 and 22, the second drive segment 54 will also contact the stationary gear 106 during the first 30 degrees of the dispensing portion of the dispensing cycle. However, during this portion of the dispensing cycle, the stationary gear 106 is not in contact with the drive roller gear 50 thus the stationary gear 106 will simply rotate in place and will not cause the sheet material 12 to be advanced. The second drive segment 54 may thus be in contact with the stationary gear 106 during a portion of both the clockwise and counterclockwise rotation of the segmented gear 18. The stationary gear 106 may be double the width of the drive roller gear 50.

The dispensing mechanism 36 may be sized so that various lengths of sheet material 12 may be advanced or dispensed therefrom. For instance, in accordance with one exemplary embodiment of the present invention, the drive roller 16 is 1 inch in diameter, thus yielding 3.14 inches of linear travel of the sheet material 12 per revolution of the drive roller 16. The dispensing mechanism 36 may be configured so that 3 inches of sheet material 12 are presented to the user at the start of the dispensing cycle. The ratio between the drive roller gear 50 and the segmented gear 18 may be selected so that 3 revolutions of the drive roller gear 50 are permitted before the segmented gear 18 contacts a fixed stop (not shown) resulting in a total of approximately 13 inches of sheet material 12 to be dispensed to the user. In accordance with other exemplary embodiments of the present invention, various gear ratios and travel may be employed in the dispenser 10 as is commonly known to one having ordinary skill in the art. Further, the diameter of the drive roller gear 50 may be varied in order to reduce the dispensing moment.

The teeth on the first and second drive segments 52, 54 of the segmented gear 18 may be variously configured in accordance with other exemplary embodiments of the present invention. The second drive segment 54 may be located adjacent to and slightly above the first drive segment 52. In the exemplary embodiment shown in FIGS. 21 and 22, the first drive segment 52 is approximately 90° while the second drive segment 54 is approximately 30° or ⅓ of the segmented gear 18. The second drive segment 54 is located between the 60° and 90° portion of the segmented gear 18.

Although shown as being a segment gear, the segmented gear 18 may be a full gear, a gear rack, or the like in accordance with other exemplary embodiments of the present invention as previously mentioned.

Figure 23:
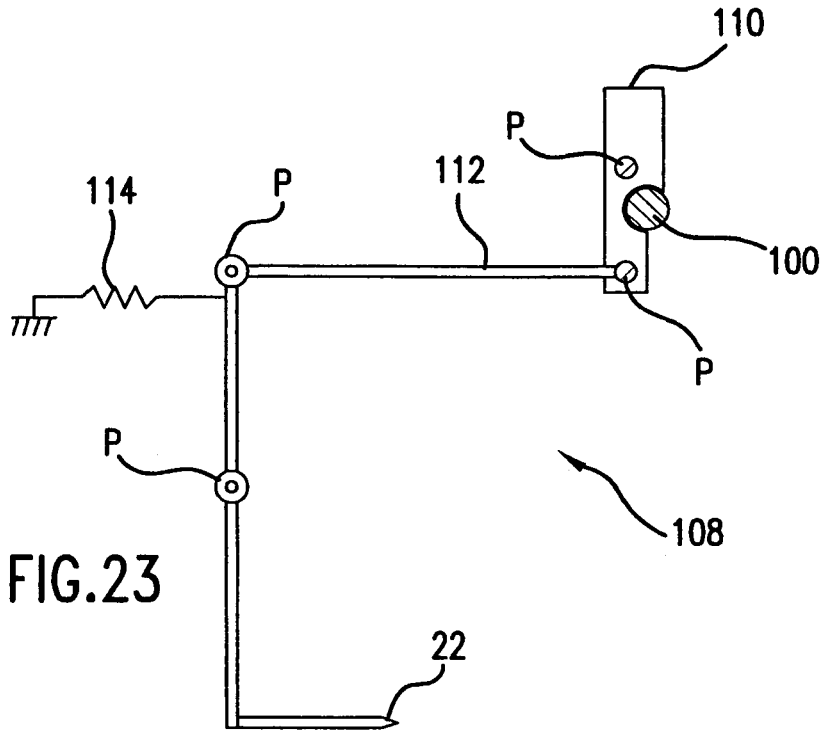
FIG. 23 is a schematic view of a lock mechanism that may be employed in an alternative exemplary embodiment of the present invention in order to prevent premature advancement of sheet material.

The possibility exists that the user will release the sheet material 12 before completion of the dispensing cycle. In this instance, the drive roller 16 will return to the at rest position thus allowing the advancement of additional sheet material 12 prematurely. In order to prevent this situation from happening, a locking mechanism 108 may be employed as shown in FIG. 23. The locking mechanism 108 includes a locking pawl 110 that is linked via a linkage 112 to a cutting blade 22. As the drive roller shaft 100 travels into the lower most portion of the slot 102, the drive roller shaft 100 pivots the locking pawl 110 out of the way until the drive roller shaft 100 locks in a recess in the locking pawl 110. In this position, the drive roller 16 cannot return to its at rest position until a cutting force is applied to the cutting blade 22 thereby pivoting the linkage 112 and locking pawl 110 to thereby release the drive roller 16 allowing for the advancement of sheet material 12. Following cutting of the sheet material 12, the cutting blade 22 and the locking pawl 110 are returned to the ready position via a spring force supplied by spring 114.

Figure 24:
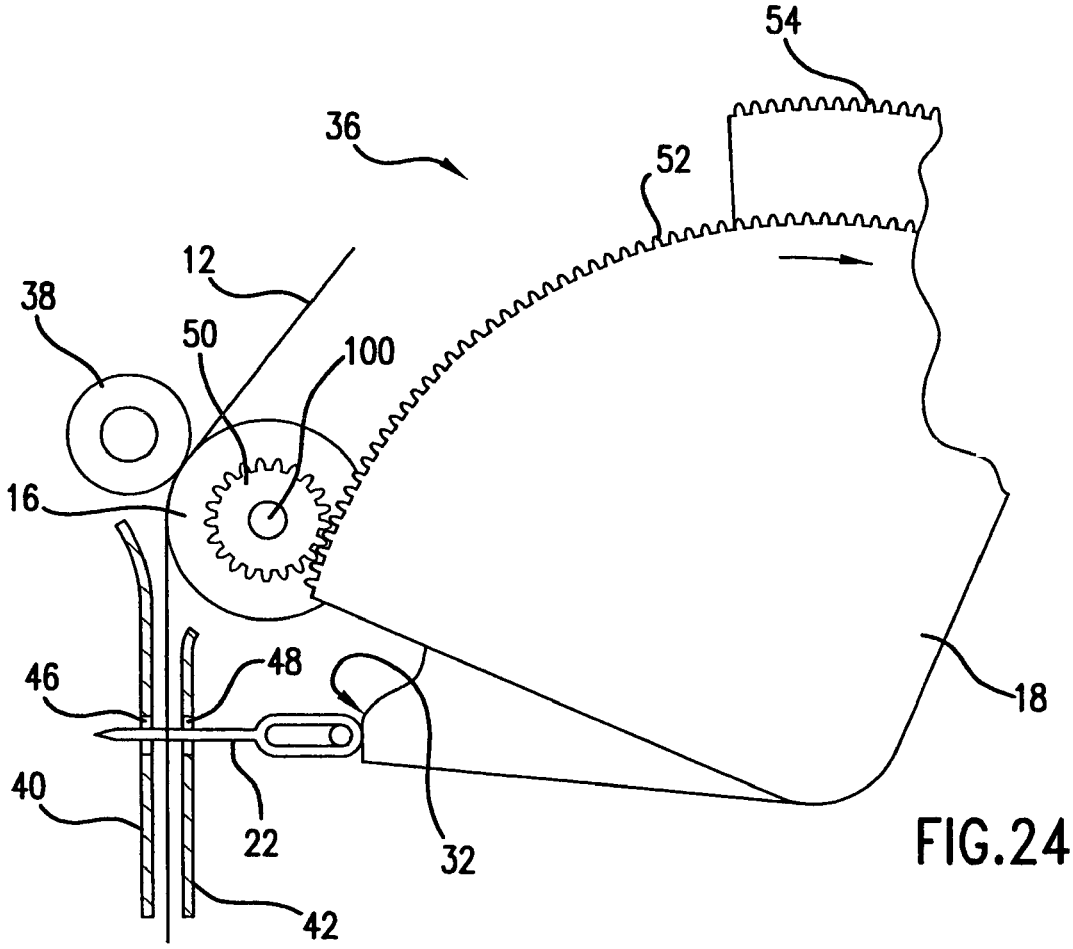
FIG. 24 is a side elevation view of an alternative exemplary embodiment of the dispenser of FIG. 19 that employs a moveable cutting blade for automatic cutoff of sheet material.

FIG. 24 shows an alternative exemplary embodiment of the dispenser 10 that employs an automatic cutting blade 22. The cutting blade 22 is slideably mounted to the frame 14 and may be spring-loaded. In accordance with this exemplary embodiment of the present invention, the segmented gear 18 defines a cam surface 32. As the segmented gear 18 reaches the end of its counterclockwise rotation during the dispensing portion of the dispensing cycle, the cam surface 32 will contact the rearward portion of the cutting blade 22 thus urging the cutting blade 22 forward into contact with the sheet material 12 to cause severing. Once the sheet material 12 is severed, the user will withdraw the severed portion and a new piece of sheet material 12 will be automatically advanced as previously discussed. Spring loading of cutting blade 22 will cause a return of the cutting blade 22 upon removal of cam surface 32.

While the exemplary embodiment shown in FIG. 24 employs a slideably mounted cutting blade 22, it is to be understood that a pivotably mounted cutting blade 22 may also be employed in accordance with other exemplary embodiments. Alternatively, a rotatably mounted cutting blade 22 may be geared to the segmented gear 18 in accordance with other exemplary embodiments of the present invention.

It should be understood that the present invention includes various modifications that can be made to the exemplary embodiments of the dispenser 10 as described herein that come within the scope of the appended claims and their equivalents.

What is claimed is:

1. A dispenser for dispensing and advancement of sheet material, comprising:

a drive roller rotationally mounted to a frame;

a sheet material engaging said drive roller such that pulling of said sheet material causes tension in said sheet material and causes said drive roller to rotate;

a segmented gear rotationally mounted to the frame, wherein said segmented gear is in communication with said drive roller, and wherein said segmented gear has a first and second drive segment;

a spring in communication with said segmented gear such that rotation of said segmented gear in a first direction caused by pulling of said sheet material causes said spring to store potential energy; and a cutting blade in communication with said segmented gear, said cutting blade configured for cutting said sheet material such that tension in said sheet material is released after cutting;

wherein release of tension in said sheet material causes said spring to release potential energy that causes said segmented gear to rotate in a second direction in order to cause said drive roller to rotate and advance said sheet material.

2. The dispenser as set forth in claim 1, wherein said cutting blade is stationary with respect to the frame.

3. The dispenser as set forth in claim 1, wherein said spring is a torsion spring.

4. The dispenser as set forth in claim 1, wherein said cutting blade is movable relative to the frame in order to engage and cut said sheet material.

5. The dispenser as set forth in claim 4, further comprising:

a cutting blade idler gear rotationally mounted to the frame; and a cutting blade drive gear rotationally mounted to the frame and in communication with said cutting blade idler gear, wherein said cutting blade is rigidly attached to said cutting blade drive gear.

6. The dispenser as set forth in claim 1, wherein said drive roller is slideably mounted to the frame.

7. The dispenser as set forth in claim 6, wherein said segmented gear defines a cam surface configured for engaging said cutting blade and causing said cutting blade to be moved in order to cut said sheet material.

8. The dispenser as set forth in claim 1, wherein said segmented gear is a segment gear.

9. A dispenser for dispensing and advancement of sheet material, comprising:

a frame;

a drive roller rotationally mounted to said frame and configured for engagement with sheet material such that rotation of said drive roller causes movement of the sheet material;

a segmented gear mounted to said frame, said segmented gear having a first and second drive segment, said first drive seciment in communication with said drive roller such that said seQmented ciear is driven in a first direction by said drive roller;

a spring in communication with said segmented gear and configured such that movement of said segmented gear in said first direction causes said spring to store potential energy and configured such that release of potential energy in said spring causes said secimented pear to move in a second direction and said first drive segment of said segmented gear to move out of communication with said drive roller and said second drive segment to move into communication with said drive roller; and a cutting blade configured for cutting the sheet material in order to release potential energy in said spring.

10. The dispenser as set forth in claim 9, wherein said cutting blade is stationary with respect to said frame.

11. The dispenser as set forth in claim 9, wherein said spring is a torsion spring.

12. The dispenser as set forth in claim 9, wherein said cutting blade is movable relative to said frame in order to engage and cut the sheet material.

13. The dispenser as set forth in claim 12, further comprising:

a cutting blade idler gear rotationally mounted to said frame; and a cutting blade drive gear rotationally mounted to said frame and in communication with said cutting blade idler gear, wherein said cutting blade is rigidly attached to said cutting blade drive gear.

14. The dispenser as set forth in claim 9, wherein said drive roller is slideably mounted to said frame.

15. The dispenser as set forth in claim 14, wherein said segmented gear defines a cam surface configured for engaging said cutting blade and causing said cutting blade to be moved in order to cut the sheet material.

16. The dispenser as set forth in claim 9, wherein said segmented gear is a segment gear.

17. A dispenser for dispensing and advancement of sheet material, comprising:

a frame;

a drive roller rotationally mounted to said frame and configured for engagement with sheet material such that rotation of said drive roller causes movement of the sheet material;

a segmented gear mounted to said frame, wherein said segmented gear is in communication with said drive roller, and wherein said segmented gear has a first and second drive segment;

a spring in communication with said segmented gear and configured such that movement of said segmented gear causes said spring to store potential energy and configured such that release of potential energy in said spring causes said segmented gear to move;

a cutting blade configured for cutting the sheet material in order to release potential energy in said spring; and further comprising a float gear rotationally and slideably mounted to said frame, wherein said float gear places said segmented gear into communication with said drive roller.

18. A dispenser for dispensing and advancement of sheet material, comprising:

a frame;

a drive roller rotationally mounted to said frame and configured for engagement with sheet material such that rotation of said drive roller causes movement of the sheet material;

a segmented gear mounted to said frame, wherein said segmented gear is in communication with said drive roller, and wherein said segmented gear has a first and second drive segment;

a spring in communication with said segmented gear and configured such that movement of said segmented gear causes said spring to store potential energy and configured such that release of potential energy in said spring causes said segmented gear to move;

a cutting blade configured for cutting the sheet material in order to release potential energy in said spring;

wherein said cutting blade is movable relative to said frame in order to engage and cut the sheet material; and further comprising a cutting blade idler gear rotationally mounted to said frame;

a cutting blade drive gear rotationally mounted to said frame and in communication with said cutting blade idler gear; and a gear rack rigidly attached to said cutting blade and in communication with said cutting blade drive gear.

19. A dispenser for dispensing and advancement of sheet material, comprising:

a drive roller rotationally mounted to a frame;

a sheet material engaging said drive roller such that pulling of said sheet material causes tension in said sheet material and causes said drive roller to rotate;

a segmented gear rotationally mounted to the frame, wherein said segmented pear is in communication with said drive roller, and wherein said segmented pear has a first and second drive segment;

a spring in communication with said segmented gear such that rotation of said segmented gear caused by pulling of said sheet material causes said spring to store potential energy;

a cutting blade in communication with said segmented gear, said cutting blade configured for cutting said sheet material such that tension in said sheet material is released after cutting;

wherein release of tension in said sheet material causes said spring to release potential energy that causes said segmented gear to rotate in order to cause said drive roller to rotate and advance said sheet material; and further comprising a float gear rotationally and slideably mounted to the frame, wherein said float gear places said segmented gear into communication with said drive roller.

20. A dispenser for dispensing and advancement of sheet material, comprising:

a drive roller rotationally mounted to a frame;

a sheet material engaging said drive roller such that pulling of said sheet material causes tension in said sheet material and causes said drive roller to rotate;

a segmented gear rotationally mounted to the frame, wherein said segmented gear is in communication with said drive roller, and wherein said segmented gear has a first and second drive segment;

a spring in communication with said segmented gear such that rotation of said segmented gear caused by pulling of said sheet material causes said spring to store potential energy;

a cutting blade in communication with said segmented gear, said cutting blade configured for cutting said sheet material such that tension in said sheet material is released after cutting;

wherein release of tension in said sheet material causes said spring to release potential energy that causes said segmented gear to rotate in order to cause said drive roller to rotate and advance said sheet material; and wherein said cutting blade is movable relative to the frame in order to engage and cut said sheet material; and further comprising a cutting blade idler gear rotationally mounted to the frame;

a cutting blade drive gear rotationally mounted to the frame and in communication with said cutting blade idler gear; and a gear rack rigidly attached to said cutting blade and in communication with said cutting blade drive gear.

21. A dispenser for dispensing and advancement of sheet material, comprising:

a frame;

a drive roller rotationally mounted to said frame;

a sheet material engaging said drive roller such that pulling of said sheet material causes tension in said sheet material and causes said drive roller to rotate;

a segmented gear rotationally mounted to said frame, wherein said segmented gear is in communication with said drive roller such that rotation of said drive roller from pulling on said sheet material causes said segmented gear to rotate in a first direction, wherein said segmented gear has a first and second drive segment, said first drive seciment is in cieared communication with said drive roller to rotate said secimented ciear in said first direction;

a spring in communication with said segmented gear such that rotation of said segmented gear in said first direction from rotation of said drive roller causes said spring to store potential energy; and a cutting blade configured for movement with respect to said frame and in communication with said segmented gear such that rotation of said segmented gear causes said cutting blade to move and cut said sheet material such that tension is said sheet material is released after cutting;

wherein release of tension in said sheet material causes said spring to release potential energy that causes said segmented gear to rotate in a second direction with said second drive segment in aeared communication with said drive roller to a cause said drive roller to rotate and cause said sheet material to advance.

* * * * *